US007487907B2

(12) United States Patent
Miller

(10) Patent No.: US 7,487,907 B2
(45) Date of Patent: Feb. 10, 2009

(54) SAFE "T" BOX

(75) Inventor: Sheila Roxann Miller, Stone Mountain, GA (US)

(73) Assignee: Sheila R. Miller, Stone Mountain, GA (US)

( * ) Notice: Subject to any disclaimer, the term of this patent is extended or adjusted under 35 U.S.C. 154(b) by 21 days.

(21) Appl. No.: 11/825,609

(22) Filed: Jul. 9, 2007

(65) Prior Publication Data

US 2009/0014509 A1 Jan. 15, 2009

(51) Int. Cl.
*B65G 11/04* (2006.01)

(52) U.S. Cl. ..... 232/45; 232/24; 232/27; 232/30; 232/39

(58) Field of Classification Search ..... 232/45, 232/30–32, 39, 17, 20, 21, 24, 25, 27; 248/156
See application file for complete search history.

(56) References Cited

U.S. PATENT DOCUMENTS 378,955 A * 3/1888 Dubey ..... 232/30
461,381 A * 10/1891 Richter ..... 232/30
1,027,524 A * 5/1912 Cook ..... 232/30
1,256,044 A * 2/1918 Schilling ..... 232/31
1,451,343 A * 4/1923 Panagopolous ..... 232/30
2,421,221 A * 5/1947 Rothe ..... 232/30
4,363,438 A * 12/1982 Connor ..... 232/30
7,040,529 B2 * 5/2006 Swider et al. ..... 232/45
2005/0247772 A1 * 11/2005 Miller ..... 232/45

* cited by examiner

*Primary Examiner*—William L. Miller

(57) ABSTRACT

A security mailbox system known as Safe "T" Box being a fully enclosed square mailbox that can be designed from PVC or some fabricated material, the Safe T Box is easy to install, environmentally friendly and will provide long service life. The mailbox includes chambers for incoming and outgoing mail being delivered via the U.S. Postal Service, it also has a chamber for newspapers/advertisements not delivered via U.S. Postal Service. The incoming mail chamber is designed for mail to go down a mail chute into a basket for pick-up through back of the locked mailbox. Outgoing mail can be placed from the back for pick-up from the front by postal worker. The mailbox is attached to the ground though internal poles extending from the bottom of the mailbox into the ground and cemented.

7 Claims, 17 Drawing Sheets

SAFE "T" BOX

REFERENCES CITED [REFERENCED BY]

"Not Applicable"

STATEMENT REGARDING FEDERALLY SPONSORED RESEARCH OR DEVELOPMENT

"Not Applicable"

THE NAMES OF THE PARTIES TO A JOINT RESEARCH AGREEMENT

"Not Applicable"

INCORPORATION-BY-REFERENCE OF MATERIAL SUBMITTED ON A COMPACT DISC

"Not Applicable"

REFERENCE TO A "MICROFICHE APPENDIX"

"Not Applicable"

BACKGROUND OF THE INVENTION

1. Field of the Invention

This invention relates to the field of mailboxes, in the category of receptacles in general mailboxes, however more particular in the security mail box arena. Mailboxes generally are of two types, the urban mailbox and the rural mailbox; both types are contained within this patent application 2. Description of Related Art The proximity of the rural mailboxes to the edge of the road allows the mail carrier to deposit mail in the rural mailbox without getting out of their vehicle since the door to such typical rural mailbox face the roadside.

Unfortunately, the fact that the single door to the typical rural mailbox faces the road means that the homeowner has to step out into the street to send or retrieve mail. This could create hazardous conditions for the homeowner, which could involve roadside/curbside accidents.

The design of the Safe "T" box, Multi Safe "T" Box, and Residential Safe "T" Box is designed to secure homeowners' mail, which also has safety in mind, and make uniformity in single family neighborhoods. The basic design allow for modifications to the Safe "T" Box allows for expanding the unit, for homeowners with multiply occupants in one home to have private mail units. The Safe "T" Box mailbox has a secure door positioned in the middle of the mailbox for easier excess then some of the standard bottom open security mailboxes used today, for those with disabilities, making the Safe "T" Mailbox easy for all homeowners' to access.

The Safe "T" Box with modifications allows city residents to have mail and small packages deposited safely and secured in the mailbox then what is currently used on the market today.

The aspects of each design are shown within the accompanying drawings.

BRIEF SUMMARY OF THE INVENTION

By virtue of this Design, the homeowner doesn't ever have to go around to the front of the mailbox, or step into the street anymore to send or retrieve mail again. The unit has a security lock panel in the rear that mail is secure for pick-up at the end of the day.

The unit is fully functional, easy to install, and durable, which makes the Safe "T" Box, Residential Box, and Multi-Safe "T" Box more effective than the current mailboxes being used today. Most current mailboxes don't have a way to secure the mail and this allows vandals to steal homeowners' personal information, using that information in Identity theft crimes.

The stand along unit is made from some sort of fabricated material, designed to be secure and safe for homeowner. The unit is completely enclosed, made from some sort of fabricated material, held together with some type of heavy duty clear glue and screws. The unit can be enclosed if the consumer wishes with bricks or remain as designed, a stand-alone unit, able to withstand the weather, keeping the U.S. Mail, newspapers/advertisements, not delivered by U.S. Postal Service secured from thieves.

DETAILED DESCRIPTION OF INVENTION

Figure 1:
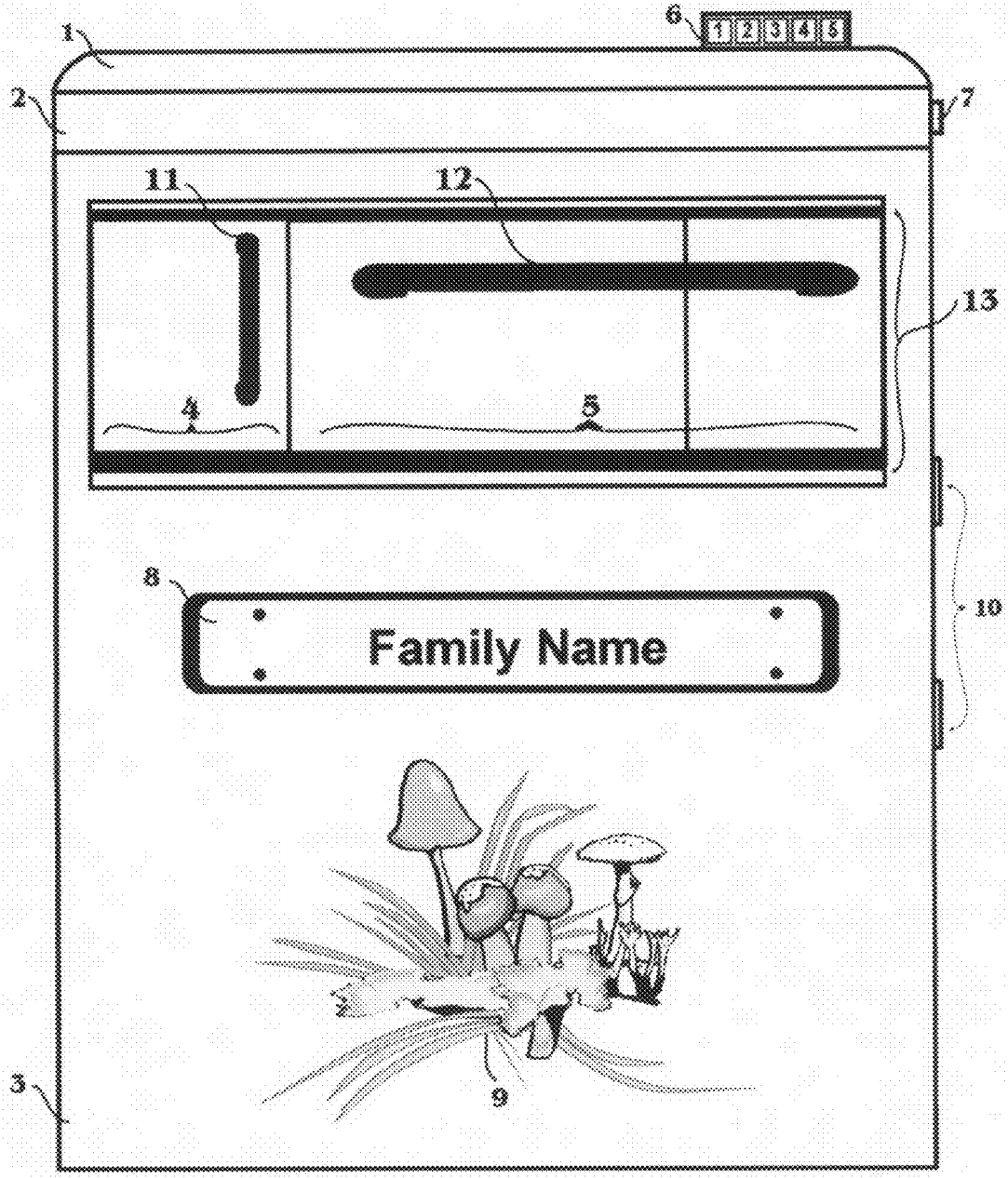
FIG. 1 depicts, front views of Safe "T" Box showing top of mailbox item (1), which interlocks with panel items (2) as one piece with cosmetic seam line, smooth exterior mailbox panel item (3), newspaper/advertisement door item (4), incoming and outgoing mail door are attached as one piece with a cosmetic seam line item (5), address placeholder item (6) for numbered address, flag holder item (7), homeowners nameplate item (8), one design element item (9) could be used on front of Safe "T" Box by homeowner, mailbox reflectors item (10) to reflect side of mailbox at night, vertical handle item (11) for newspaper/advertisement door, horizontal handle item (12) for pull down door, front elongated chamber item (13) that houses chambers for outgoing, incoming and newspaper/advertisement panels.

FIG. 1 depicts a mailbox that could be constructed from CPVC or some sort of fabricated material can be safer for the consumer and functional for securing homeowners mail. The unit will be about 60 inches in height, about 26 inches wide and 26 inches in length.

Top of mailbox 1 26 inches wide by 26 inches in length, 1 interlocks with panel 2 as one piece with ¼ inch cosmetic seam line between the two sections to give the illusion that 1 and 2 are separate sections, for a combined length of 8 inches in height, 1 is ½ inch thick, 2 inches in height, has about a 15-degree raised top with about a 15-degree angled curved sides for rain or snow to runoff mailbox, 2 is 6 inches in height, 1-inch thick, corner portion of 2 is trimmed down from 1 inch to ½ inch thick, which interlocks with interlocking panel 23 (FIG. 6), which is trimmed down ½ inch to interlock with interlocking panel 2*a* (FIG. 6), seams are glued with some sort of heavy duty clear glue and screwed 33 (FIG. 6), with some sort of threaded post with screws, about 1 inch long, to secure interlocking panels together. Exterior mailbox panel 3 comprises of 4 interlocking panels 2 top panel which interlocks with 2*a* (FIG. 6), shows interlocking base panel for front and back panel from interior view, 3 smooth exterior front and rear panel (FIG. 4), 23 (FIG. 6), side panel, Exterior panels are 50 inches in height, 26 inches wide, smooth on exterior side of mailbox, trimmed on interior side to create interlocking components, made from some sort of fabricated material.

Mounted in the front upper chamber of the mailbox is the elongated housing chamber 13 housing is 25 inches long by 25 inches wide, 13 inches high, with ½ inch cosmetic seam line on top and bottom of elongated housing chamber, constructed from some sort of fabricated material as one piece, consisting of a pull down retractable door 5 18-inch wide and 13 inches in height, thickness of the pull down door 5 is ½ inch thick, for incoming and outgoing mail (FIG. 11), with horizontal handle 12 handle is 9 inches long, made from some sort of plastic, metal or fabricated material, attached to inside door 5 with screws for pull down door to open or close.

Also, mounted in the front upper chamber of the mailbox is the elongated housing chamber 13 is the newspaper/advertisement door 4 is a swing door, 8 inches wide, 13 inches high, ½ inch thick, that swings opens to insert newspaper/advertisement or other items not delivered via U.S. Postal Service and closes when not in use, vertical handle 11 handle is 7 inches long, made from some sort of plastic, metal or fabricated material, attached to inside door 4 with screws for the swinging door to pull open or close.

Address placeholder 6 housing for address is 6 inches long, 1½ inches high, ¼ inch thick, consisting of 5 numeral place holders for address, numbers for address are 1 inch high, sticky backed numbers currently used on market today, address placeholder will have some sort of circular base attachments that will fit into pre-drilled circular holes for address placeholder to mount on top (FIG. 7), address placeholder is made from plastic, metal or some sort of fabricated material.

Conventional flag holder 7 mounted on the side of the mailbox, standard market item used today with screw attachment.

Homeowners nameplate 8 nameplate is 20 inches long by 2 inches high, nameplate has about a ¼-inch border, made from some sort of fabricated material, holding up to about 18 1-inch letters for the homeowners' name, sticky backed letters currently used on market today, base of nameplate has two holes which allow up to two additional families' name to be added to front of the Safe "T" Box mailbox, additional name plate are attached with "S" hooks to expand nameplate when necessary.

Design element 9 size of design element is about 11×17, allowing homeowner to personalize front panel of mailbox, designs range from sports, gardening, automobiles, the arts, etc., designs are made on computer, from peel away adhesive backed plastic artist print paper that is whether resistant, pressed and rubbed into position in front of mailbox.

Mail reflectors 10 reflectors about 4 inches in height, either circle or square with sticky backing, reflectors come in different colors and attached to side of mailbox, homeowner can see side of mailbox at night when they approach driveway at night.

Figure 2:
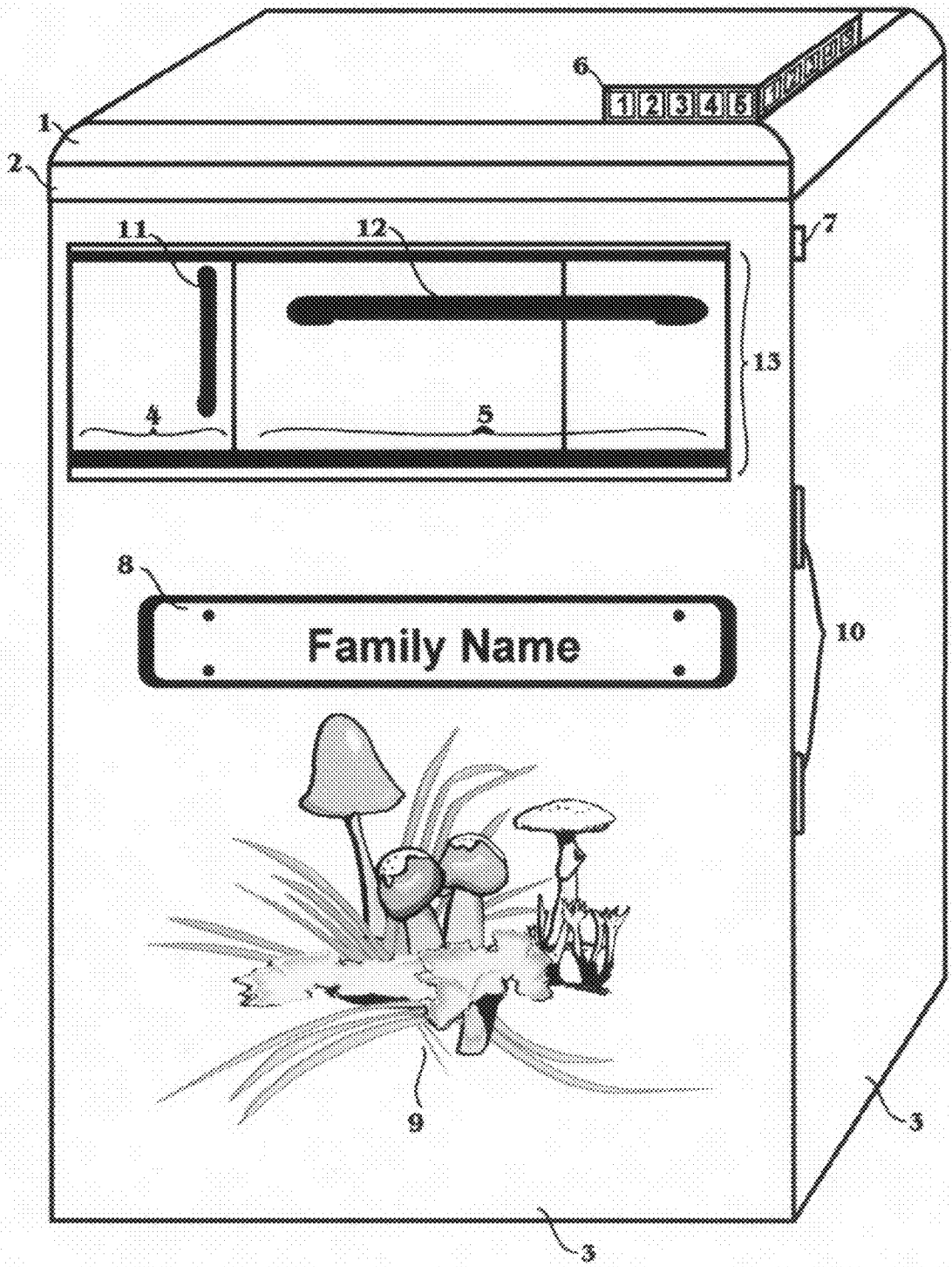
FIG. 2 depicts, Safe "T" Box on an angle, showing top of mailbox item (1), which interlocks with panel items (2) as one piece with cosmetic seam line, smooth exterior mailbox panel item (3), newspaper/advertisement door item (4), incoming and outgoing mail door are attached as one piece with a cosmetic seam line item (5), address placeholder item (6) shown with front and side address place holders for numbered address, flag holder item (7), homeowners nameplate item (8), one design element item (9) could be used on front of Safe "T" Box by homeowner, mailbox reflectors item (10) to reflect side of mailbox at night, vertical handle item (11) for newspaper/advertisement door, horizontal handle item (12) for pull down door, front elongated chamber item (13) that houses chambers for outgoing, incoming and newspaper/advertisement.

FIG. 2 depicts Safe "T" Box on angle, showing 1 interlocks with panel 2 as one piece with ¼ inch cosmetic seam line between the two sections in front of mailbox to give the illusion that 1 and 2 are separate sections, exterior mailbox panel 3 smooth exterior panels, made from some sort of plastic or fabricated material, comprised of 4 separate interlocking panels, 50 inches in height, 26 inches wide that interlock together to make sealed enclosure, 2 top panel which interlocks with 2*a* (FIG. 6), 2*a* shows interlocking base panel for front and back panel from interior view, 3 smooth exterior view of front and 3 rear panel (FIG. 4), 23 side panel (FIG. 6), showing trimmed down interior interlocking panel with exterior smooth side of exterior panel.

Newspaper/advertisement door 4 swinging door, 8 inches wide, 13 inches high, ½ inch thick, that swings opens to retrieve newspaper/advertisement or other items not delivered via U.S. Postal Service and close when not in use, outgoing mail door and incoming mail door 5 pull down retractable door 5 18-inch wide and 13 inches in height, thickness of the pull down door 5 is ½ inch thick.

Address placeholder 6 housing for address is 6 inches long, 1½ inches high, ¼ inch thick, consisting of 5 numeral place holders for address, shown from front and side view of mailbox, numbers for address are 1 inch high, sticky backed numbers currently used on market today, address placeholder will have some sort of circular base attachments that will fit into pre-drilled circular holes for address placeholder to mount on top (FIG. 7), address placeholder is made from plastic, metal or some sort of fabricated material, conventional flag holder 7 mounted on the side of the mailbox, standard market item used today with screw attachment, homeowners nameplate 8 nameplate is 20 inches long by 2 inches high, nameplate has about a ¼-inch border, holding up to about 18 1-inch letters for the homeowners' name, sticky backed letters currently used on market today, base of nameplate has two holes which allow up to two additional families' name to be added to front of the Safe "T" Box mailbox, additional name plate are attached with "S" hooks to expand nameplate when necessary, design element 9 size of design element is about 11×17, allowing homeowner to personalize front panel of mailbox, designs range from sports, gardening, automobiles, the arts, etc., designs are made on computer, from peel away adhesive backed plastic artist print paper that is whether resistant, pressed and rubbed into position in front of mailbox, mailbox reflectors 10 reflectors about 4 inches in height, either circle or square with sticky backing, reflectors come in different colors and attached to side of mailbox, homeowner can see side of mailbox at night when they approach driveway at night, vertical handle 11 handle is 7 inches long, made from some sort of plastic, metal or fabricated material, attached to inside door 4 with screws for the swinging door to pull open or close, horizontal handle 12 handle is 9 inches long, made from some sort of plastic, metal or fabricated material, attached to inside door 5 with screws for pull down door to open or close.

Front elongated housing chamber 13 housing is 25 inches long by 25 inches wide, 13 inches high, with ½ inch cosmetic seam line on top and bottom of elongated housing chamber, constructed from some sort of fabricated material as one piece to house outgoing, incoming mail compartments and newspaper/advertisement compartment.

Figure 3:
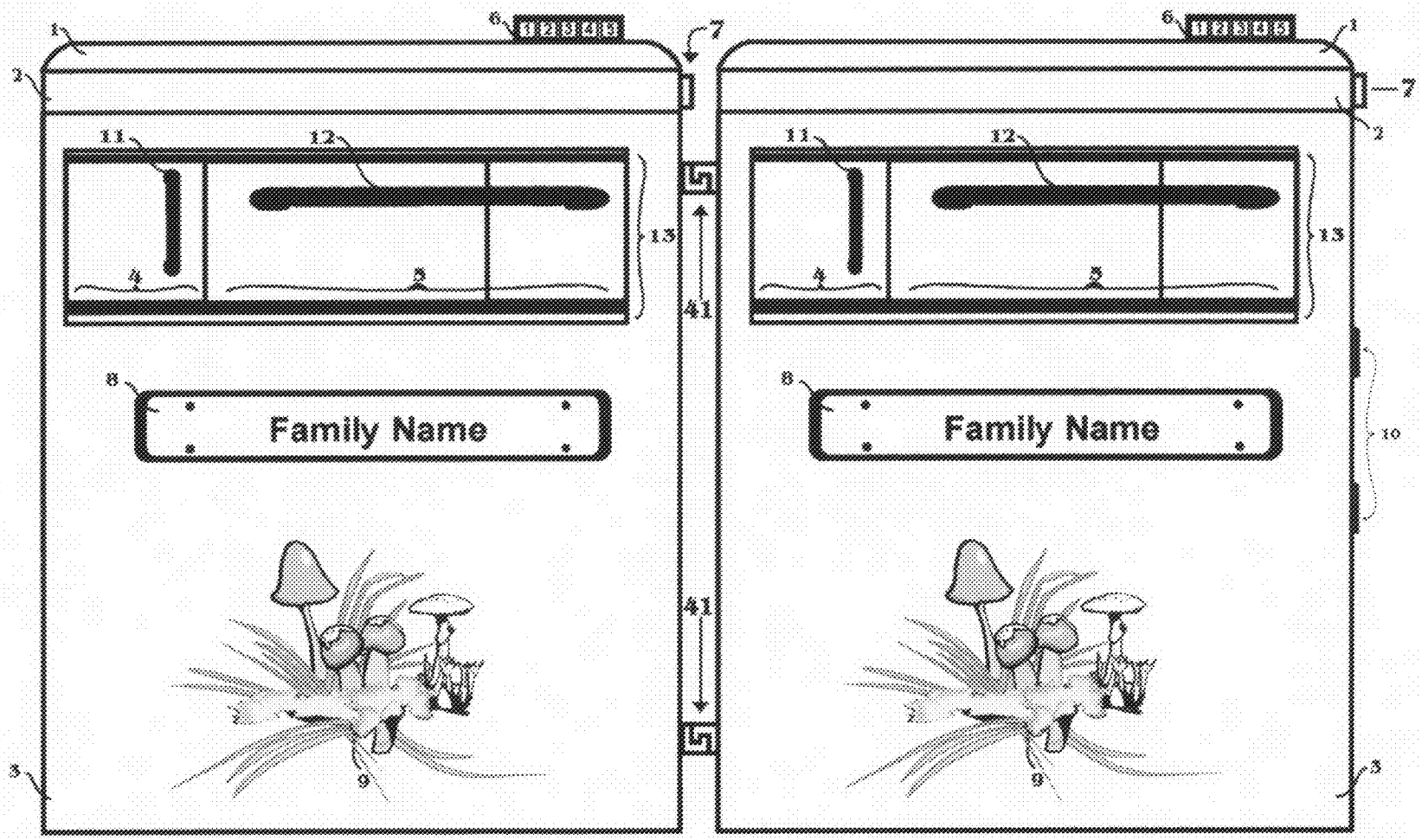
FIG. 3 depicts, how Safe "T" Box mailbox is used to create Multi Safe "T" Box mailbox, interlocking hinge attachment item (41) shows closed interlocking hinge that mount to the side of the Safe "T" Box mailbox allowing for expansion of unit for each family to have a secure and private mail unit in front of multi-dwellings occupied homes, newspaper/advertisement door item (4), incoming and outgoing mail door are attached as one piece with a cosmetic seam line item (5), address placeholder item (6) for numbered address, flag holder item (7), homeowners nameplate item (8), one design element item (9) could be used on front of Safe "T" Box by homeowner, reflectors item (10) to reflect side of mailbox at night, vertical handle item (11) for newspaper/advertisement door, horizontal handle item (12) for pull down door, front elongated chamber item (13) that houses chambers for outgoing, incoming and newspaper/advertisement.

FIG. 3 depicts original mailbox showing top for mailbox 1 26 inches wide by 26 inches in length, 1 interlocks with panel 2 as one piece with ¼ inch cosmetic seam line between the two sections to give the illusion that 1 and 2 are separate sections, for a combined length of 8 inches in height, 1 is ½ inch thick, 2 inches in height, has about a 15-degree raised top with about a 15-degree angled curved sides for rain or snow to runoff mailbox, 2 is 6 inches in height, 1-inch thick, corner portion of 2 is trimmed down from 1 inch to ½ inch thick, which interlocks with interlocking panel 23 (FIG. 6), which is trimmed down ½ inch to interlock with interlocking panel 2*a* (FIG. 6), seams are glued with some sort of heavy duty clear glue and screwed 33 (FIG. 6), with some sort of threaded post with screws, about 1 inch long, to secure interlocking panels together. Exterior mailbox panel 3 comprises of 4 interlocking panels 2 top panel which interlocks with 2*a* (FIG. 6), shows interlocking base panel for front and back panel from interior view, 3 smooth exterior front and rear panel (FIG. 4), 23 (FIG. 6), side panel, Exterior panels are 50 inches in height, 26 inches wide, smooth on exterior side of mailbox, trimmed on interior side to create interlocking components, made from some sort of fabricated material.

Mounted in the front upper chamber of the mailbox is the elongated housing chamber 13 housing is 25 inches long by 25 inches wide, 13 inches high, with ½ inch cosmetic seam line on top and bottom of elongated housing chamber, constructed from some sort of fabricated material as one piece, consisting of a pull down retractable door 5 18-inch wide and 13 inches in height, thickness of the pull down door 5 is ½ inch thick, for incoming and outgoing mail (FIG. 11), with horizontal handle 12 handle is 9 inches long, made from some sort of plastic, metal or fabricated material, attached to inside door 5 with screws for pull down door to open or close.

Newspaper/advertisement door 4 swing door, 8 inches wide, 13 inches high, ½ inch thick, that swings opens to insert newspaper/advertisement or other items not delivered via U.S.

Postal Service and closes when not in use, vertical handle 11 handle is 7 inches long, made from some sort of plastic, metal or fabricated material, attached to inside door 4 with screws for the swinging door to pull open or close.

Address placeholder 6 housing for address is 6 inches long, 1½ inches high, ¼ inch thick, consisting of 5 numeral place holders for address, numbers for address are 1 inch high, sticky backed numbers currently used on market today, address placeholder will have some sort of circular base attachments that will fit into pre-drilled circular holes for address placeholder to mount on top (FIG. 7), address placeholder is made from plastic, metal or some sort of fabricated material.

Conventional flag holder 7 mounted on the side of the mailbox, standard market item used today with screw attachment.

Homeowners nameplate 8 nameplate is 20 inches long by 2 inches high, nameplate has about a ¼-inch border, made from some sort of fabricated material, holding up to about 18 1-inch letters for the homeowners' name, sticky backed letters currently used on market today, base of nameplate has two holes which allow up to two additional families' name to be added to front of the Safe "T" Box mailbox, additional name plate are attached with "S" hooks to expand nameplate when necessary.

Design element 9 size of design element is about 11×17, allowing homeowner to personalize front panel of mailbox, designs range from sports, gardening, automobiles, the arts, etc., designs are made on computer, from peel away adhesive backed plastic artist print paper that is whether resistant, pressed and rubbed into position in front of mailbox.

Mail reflectors 10 reflectors about 4 inches in height, either circle or square with sticky backing, reflectors come in different colors and attached to side of mailbox, homeowner can see side of mailbox at night when they approach driveway at night.

Interlocking hinge attachment 41 to create multi-Safe "T" Box mailboxes, interlocking hinge attachment 41 mounts to sides of the mailbox, made from some sort of fabricated material, interlocking hinges are 1 inches wide by 1 inches high, ½ inch thick, one near the top, one near the bottom, each interlocking hinge is glued with some sort of heavy duty clear glue, attached with some sort of screw, allowing for attachment of more then one mailbox at a time.

Figure 4:
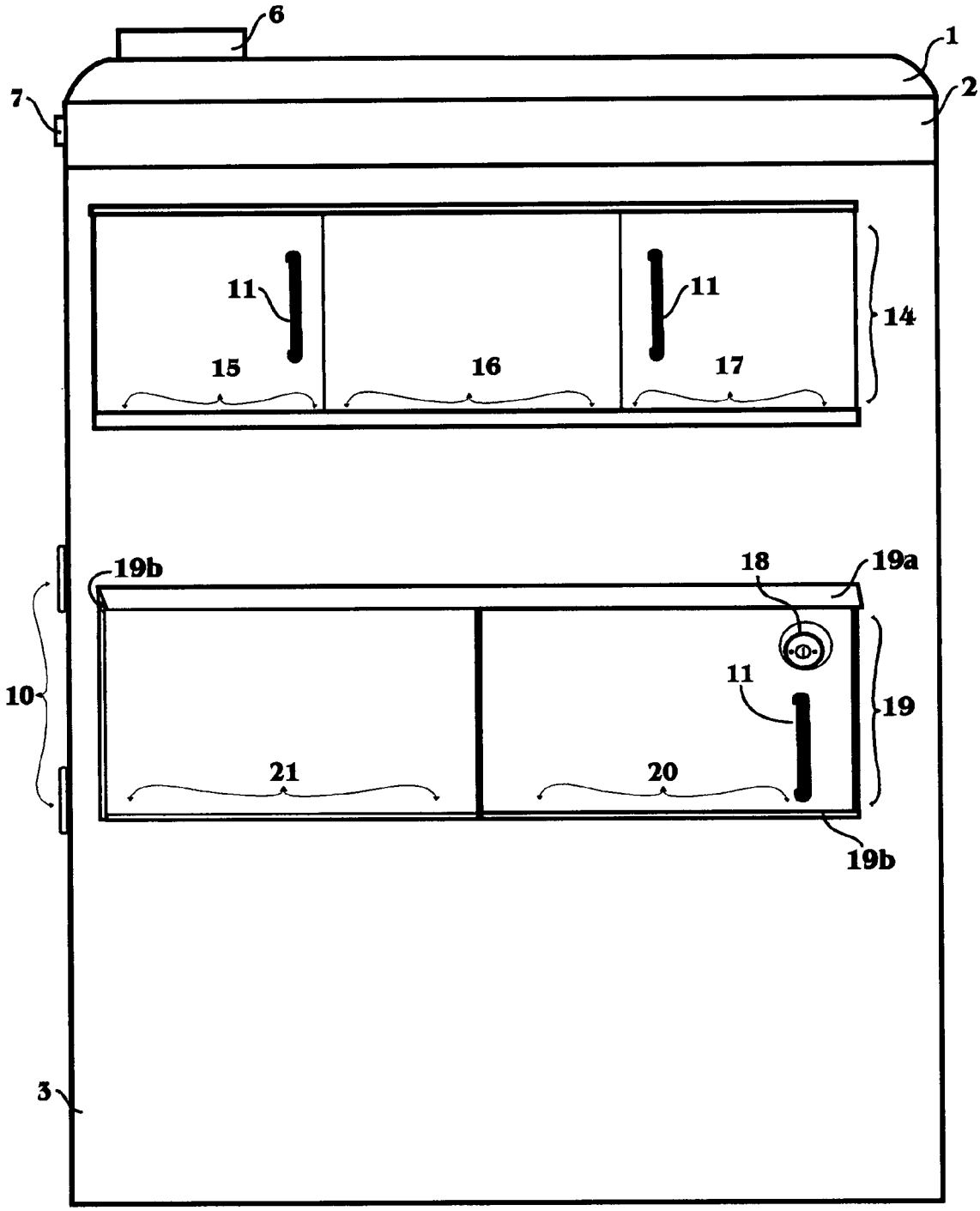
FIG. 4 depicts, back view of the Safe "T" Box, showing top of mailbox item (1) which interlocks with panel items (2) as one piece with cosmetic seam line, smooth exterior mailbox panel item (3), address placeholder item (6) for numbered address, flag holder item (7) signals postal worker outgoing mail awaiting pick-up, mailbox reflectors item (10) to reflect side of mailbox at night, vertical handle item (11) attaches to door in opening and closing, upper elongated housing chamber item (14) housing rear outgoing mail swing door item (15), rear non-functioning panel item (16), rear newspaper/advertisement swing door item (17), rear elongated housing chamber item (19) housing chambers for security door panel, security key entry lock item (18) key entry lock for securing door when not in use, awning cover item (19*a*) to protect lock mechanism from elements, divided grooved sleeve glider item (19*b*) used inside of mailbox for sliding door as a stabilizer track gilding rim, sliding door item (20) slides open and close when mail is retrieved, non-movable door item (21) door has no function.

FIG. 4 depicts back view of Safe "T" Box, showing 1 interlocks with panel 2 as one piece with ¼ inch cosmetic seam line between the two sections to give the illusion that 1 and 2 are separate sections, Exterior mailbox panel 3 comprises of 4 interlocking panels 2 top panel which interlocks with 2*a* (FIG. 6), shows interlocking base panel for front and back panel from interior view, 3 smooth exterior front and rear panel (FIG. 4), 23 (FIG. 6), side panel, Exterior panels are 50 inches in height, 26 inches wide, smooth on exterior side of mailbox, trimmed on interior side to create interlocking components, made from some sort of fabricated material.

Address placeholder 6 back view of housing for address is 6 inches long, 1½ inches high, ¼ inch thick, consisting of 5 numeral place holders for address, shown from front and side view if mailbox, numbers for address are 1 inch high, sticky backed numbers currently used on market today, address placeholder will have some sort of circular base attachments that will fit into pre-drilled circular holes for address placeholder to mount on top (FIG. 7), address placeholder is made from plastic, metal or some sort of fabricated material, conventional flag holder 7 mounted on the side of the mailbox, standard market item used today with screw attachment.

Rear upper elongated chamber 14 that attaches to front elongated housing chamber 13 in the rear of the mailbox, which front elongated housing chamber 13 is 25 inches long by 25 inches wide, 13 inches high which extends through upper chamber of mailbox to rear upper elongated chamber 14 and attaches to one another to make one continuous chamber, with ½ inch cosmetic seam line on top and bottom of rear upper elongated housing chamber, constructed from some sort of fabricated material as one piece.

Figure 17:
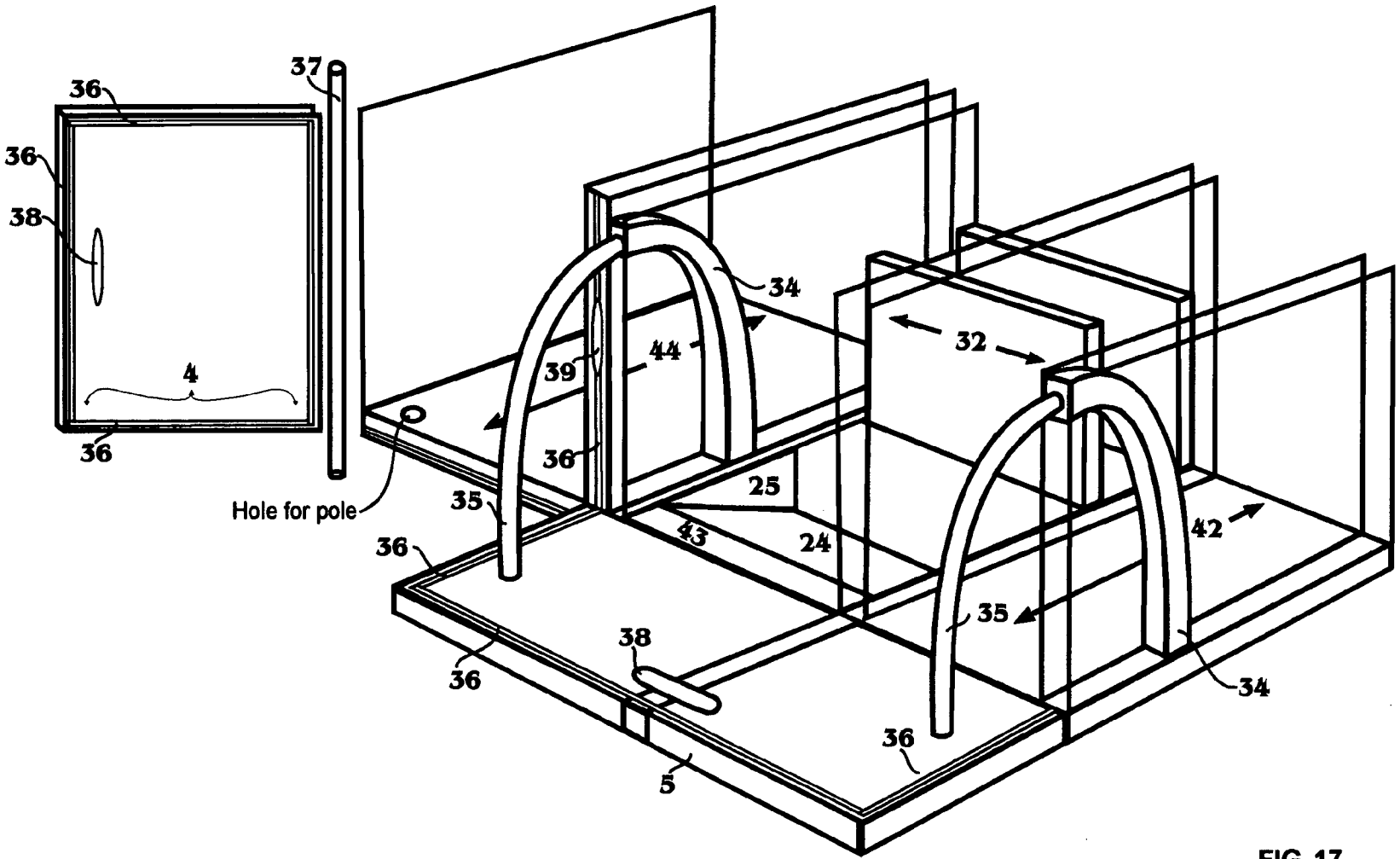
FIG. 17 depicts, front elongated housing chamber item (13) of Safe "T" Box mailbox without cover showing newspaper/advertisement door item (4) door open, incoming mail and outgoing mail door attached as one piece with a cosmetic seam line item (5) with door open, non-functioning panel item (16) that has no function and is the back of the incoming mail chamber, mailbox chute item (24) which mail travels into mailbox for pick-up, mailbox chute guardrail item (25) which guides mail into basket, bumper board item (32) mail hits bumper board and falls into basket, 45-degree angled stationary arm housing item (34), 45-degree angled retractable movable arm item (35) that retracts when door is closed, thin rubber trim item (36) attached around the edge of each door to protect mail from getting wet, stabilizer swing door pole item (37) enables door to swing open and close, magnets item (38), (39) keeps door closed when not in use, outgoing mail holding chamber item (42) chamber for outgoing mail to rest in for pick-up, incoming mail chamber item (43) to secure mail for pick-up, newspaper/advertisement chamber item (44) chamber for newspaper/advertisement and other items to rest in for pick-up.

Rear outgoing mail door 15 swinging door, 8 inches wide, 13 inches in height, ½ inch thick, that swings opens to retrieve newspaper/advertisement or other items not delivered via U.S. Postal Service and close when not in use, vertical handle 11 handle is 7 inches long, made from some sort of plastic, metal or fabricated material, handle is attached to inside door 15 with screws for the swinging door to pull open and close, stabilizer swing door pole 37 (FIG. 17), about ½ hollow circular pole, 16 inches long, extends 1 inch into the upper interior portion of 2 about 1 inch down into the chamber 42 (FIG. 17), for door to swing open and close, rear non-functioning panel 16 that is 9 inches wide by 13 inches high, ½ thick, non-functioning door panel is part of incoming mail chamber 43 (FIG. 17).

Rear newspaper/advertisement door 17 swinging door, 8 inches wide, 13 inches in height, ½ inch thick, that swings opens to retrieve newspaper/advertisement or other items not delivered via U.S. Postal Service and close when not in use, vertical handle 11 handle is 7 inches long, made from some sort of plastic, metal or fabricated material, handle is attached to inside door 17 with screws for the swinging door to pull open and close, stabilizer swing door pole 37 (FIG. 17), about ½ hollow circular pole, 16 inches long, extends 1 inch into the upper interior portion of 2 about 1 inch down into the chamber 44 (FIG. 17), for door to swing open and close.

Rear elongated housing chamber 19 housing is 20 inches long by 24 inches wide, 19 inches high, with ½ inch cosmetic seam line on top and bottom of elongated housing chamber.

Security lock 18 standard market key entry security lock that is currently used on homeowners' front door will be used for Safe "T" Box mailboxes.

Awning cover 19*a* ½ inch angle awning, ½ inch wide, 24 inches long, to protect lock mechanism from rusting due to rain and snow runoff.

Stabilizer track gilding rim seam 19*b* depicts divided grooved sleeve, 24 inches long, attaches top and bottom of rear elongated housing chamber 19 made from some sort of fabricated material, attached to interior with some sort of heavy duty glue and screws, stabilizer track gilding rim has a thin ¼ inch high groove divided seam line between the 1 inch wide internal seam to ensure even gliding of door 20 sliding door 20 is 10 inches wide by 18 inches high, ½ inches thick, made from some sort of fabricated material, sliding door fits into stabilizer track gilding rim seam 19*b* to ensure even gliding of door 20 vertical handle 11 handle is 7 inches long, made from some sort of plastic, metal or fabricated material, attached to inside sliding door 20 with screws for the door to slide open or close, non-movable door 21 which is 10 inches wide by 18 inches high, ½ inches thick, non-functioning door fits into top stabilizer track gilding rim seam 19*b* for housing stability of non-movable door.

Figure 5:
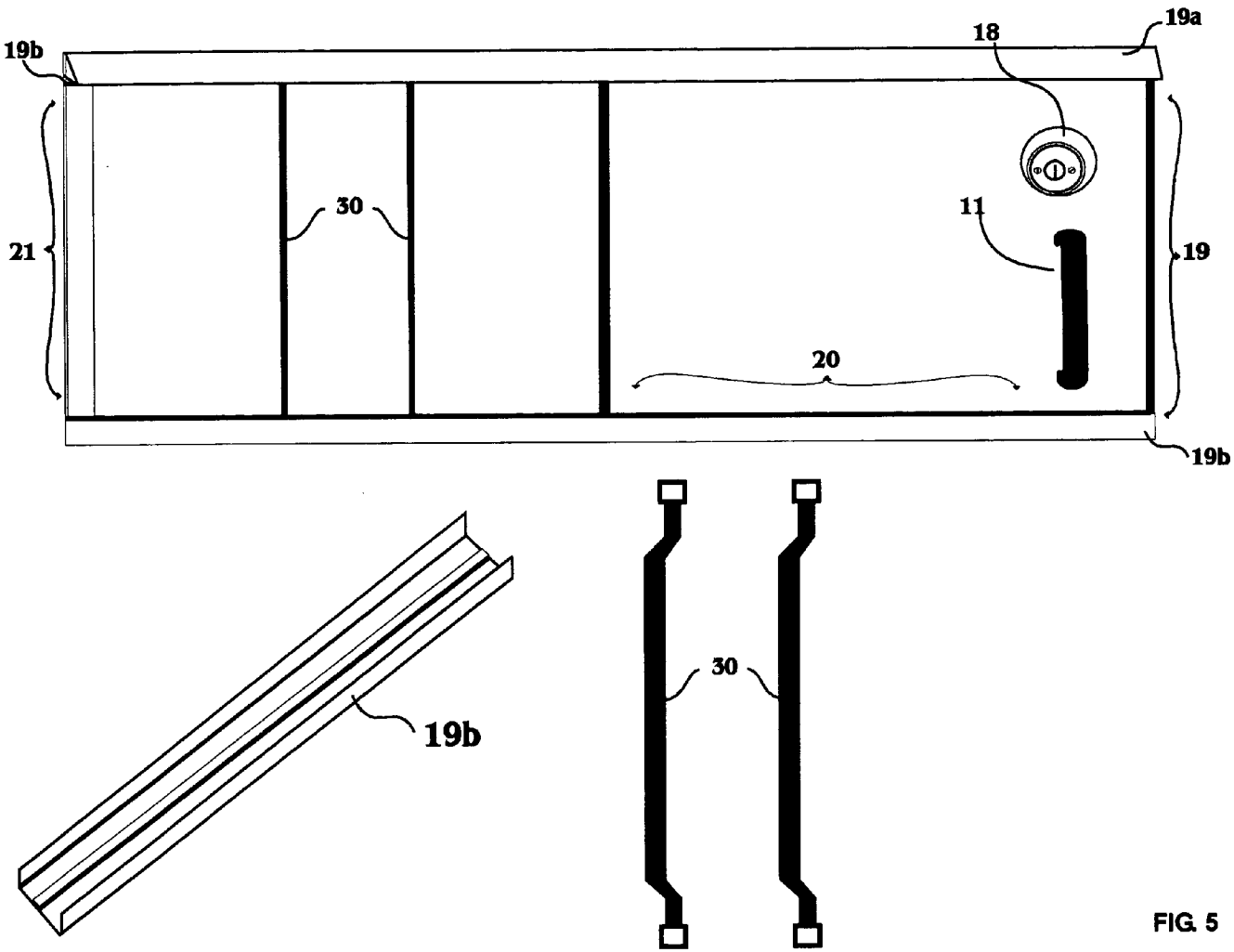
FIG. 5 depicts, elongated housing chamber item (19) housing chambers for security key entry lock item (18) lock for securing door when not in use, awning cover item (19*a*) to protect lock mechanism from elements, divided grooved sleeve glider item (19*b*) used inside of mailbox as a stabilizer track gilding rim for sliding door sliding door item (20) slides open and close when mail is retrieved, vertical handle item (11) attaches to door for opening and closing, non-movable door item (21) door has no function, stabilizer bars item (30) positioned on the inside the non-movable door for added strength, the stabilizer bars are attached to inside wall of the Safe "T" Box with some sort of screws or some sort of heavy duty glue, stabilizer bars are shown extracted from non-moveable door to better show side view of stabilizer bars, stabilizer track gliding rim item (19*b*) is shown extracted from non-moveable door to better show view of track gliding rim.

FIG. 5 depicts Rear elongated housing chamber 19 housing is 20 inches long by 24 inches wide, 19 inches high, with ½ inch cosmetic seam line on top and bottom of elongated housing chamber.

Security lock 18 standard market key entry security lock that is currently used on homeowners' front door will be used for Safe "T" Box mailboxes, awning cover 19*a* is a ½ inch angle awning, ½ inch wide, 24 inches long, to protect lock mechanism from rusting due to rain and snow runoff, stabilizer track gilding rim seam 19*b* depicts divided grooved sleeve, 24 inches long, attaches top and bottom of rear elongated housing chamber 19 made from some sort of fabricated material, attached to interior with some sort of heavy duty glue and screws, stabilizer track gilding rim has a thin ¼ inch high groove divided seam line between the 1 inch wide internal seam to ensure even gliding of door 20 sliding door 20 that is 10 inches wide by 18 inches high, ½ inches thick, made from some sort of fabricated material, sliding door fits into stabilizer track gilding rim seam 19*b* to ensure even gliding of door 20 vertical handle 11 handle is 7 inches long, made from some sort of plastic, metal or fabricated material, attached to inside sliding door 20 with screws for the door to slide open or close.

Internal view of non-movable door 21 with stabilizer bars 30 non-movable bars, 22 inches high, ½ inches wide, ½ inches thick, attached to inside of mailbox for added reinforcement of non-moveable door 21 made from some sort of plastic, metal or fabricated material, attached with some sort of screws, stabilizer bars 30 are extracted from rear middle elongated housing chamber 19 to show detailed side view of stabilizer bars 30 stabilizer track gilding rim 19*b* is extracted to show detailed view of stabilizer track gilding rim 19*b* which has a thin ¼ inch high grooved divided seam line to ensure even gliding of door 21 when door is open and closed to retrieval the mail.

Figure 6:
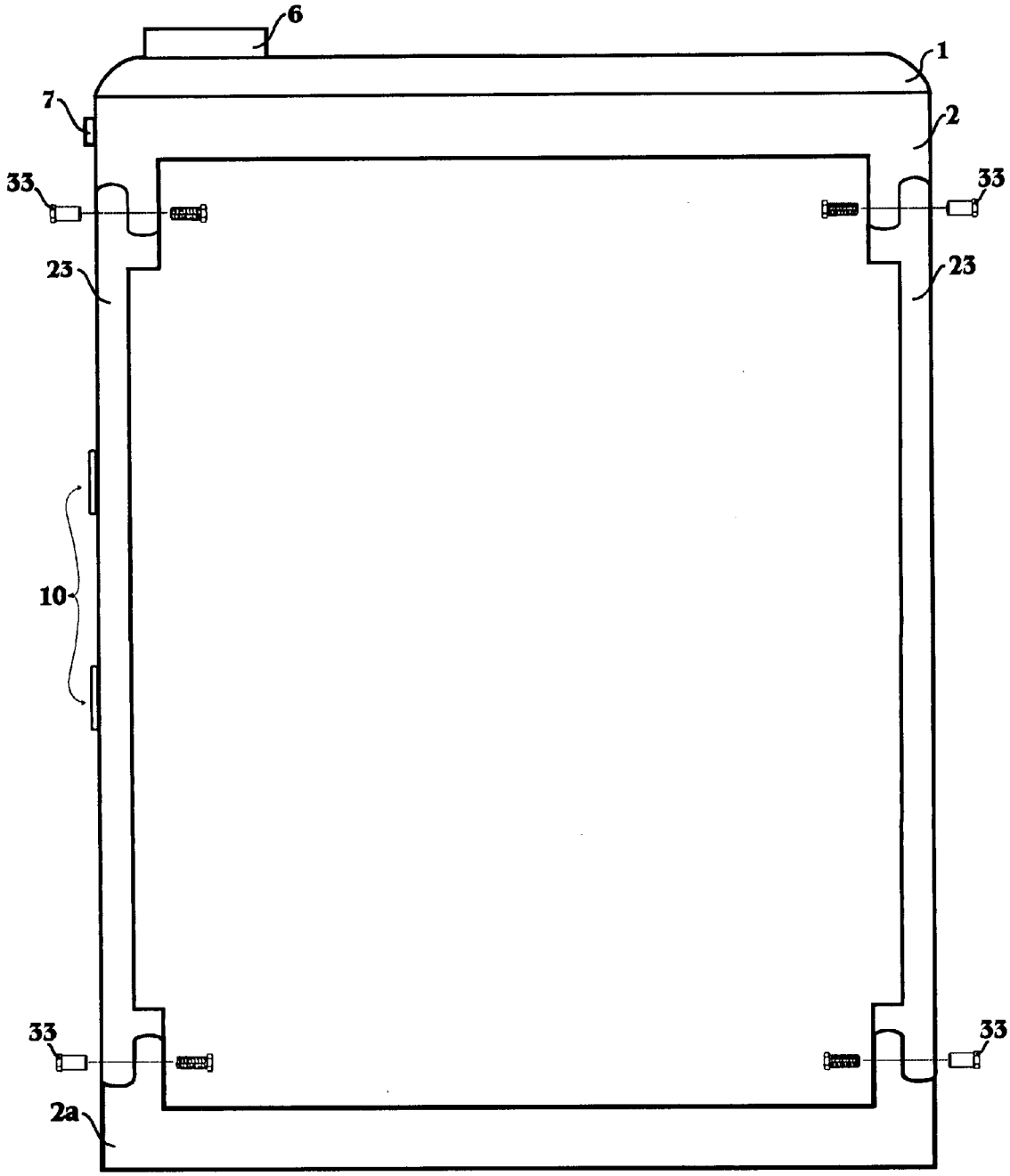
FIG. 6 depicts, top of mailbox item (1) which interlocks with panel items (2) as one piece with cosmetic seam line, interlocking panel are shaped from 1 inch down to ½ inch which create interlocking connections for interlocking panels items (2*a*) base of unit that sits upon ground, interlocking panel are shaped from 1 inch down to ½ inch which create interlock connections, smooth exterior mailbox panel item (3), address placeholder item (6) for numbered address, flag holder item (7) signals postal worker outgoing mail awaiting pick-up, reflectors item (10) to reflect side of mailbox at night, interlocking panels item (23) interlocking panel are shaped from 1 inch down to ½ inch which create interlock connections, screw with interlocking screw chamber item (33) to secure interlocking panels.

FIG. 6 depicts top of mailbox 1 26 inches wide by 26 inches long, interlocks with panel 2 as one piece with ¼ inch cosmetic seam line between the two sections for a combined length of 8 inches, 1 is ½ inch thick, 2 inches in height, has about a 15-degree raised top with about a 15-degree angled curved sides for rain or snow to runoff mailbox, 2 is 6 inches in height, 1-inch thick, corner portion of 2 is trimmed down from 1 inch to ½ inch thick, which interlocks with interlocking panel 23 which is trimmed down ½ inch to interlock with interlocking panel 2*a* seams are glued with some sort of heavy duty clear glue, and screwed 33 will be some sort of threaded post with screws, about 1 inch long, to secure interlocking panels 2 (FIG. 6), 2*a* (FIG. 6), 3 (FIG. 1), 23 (FIG. 6), together, screwed with interlocking screw chamber 33 screws will be some sort of threaded post with screws, about 1 inch long, to secure interlocking panels which creates mailbox enclosure.

Address placeholder 6 back view of housing for address is 6 inches long, 1½ inches high, ¼ inch thick, consisting of 5 numeral place holders for address, shown from front and side view if mailbox, numbers for address are 1 inch high, sticky backed numbers currently used on market today, address placeholder will have some sort of circular base attachments that will fit into pre-drilled circular holes for address placeholder to mount on top (FIG. 7), address placeholder is made from plastic, metal or some sort of fabricated material, conventional flag holder 7 mounted on the side of the mailbox, standard market item used today with screw attachment, mail reflectors 10 reflectors about 4 inches in height, either circle or square with sticky backing, reflectors come in different colors and attached to side of mailbox, homeowner can see side of mailbox at night when they approach driveway at night.

Figure 7:
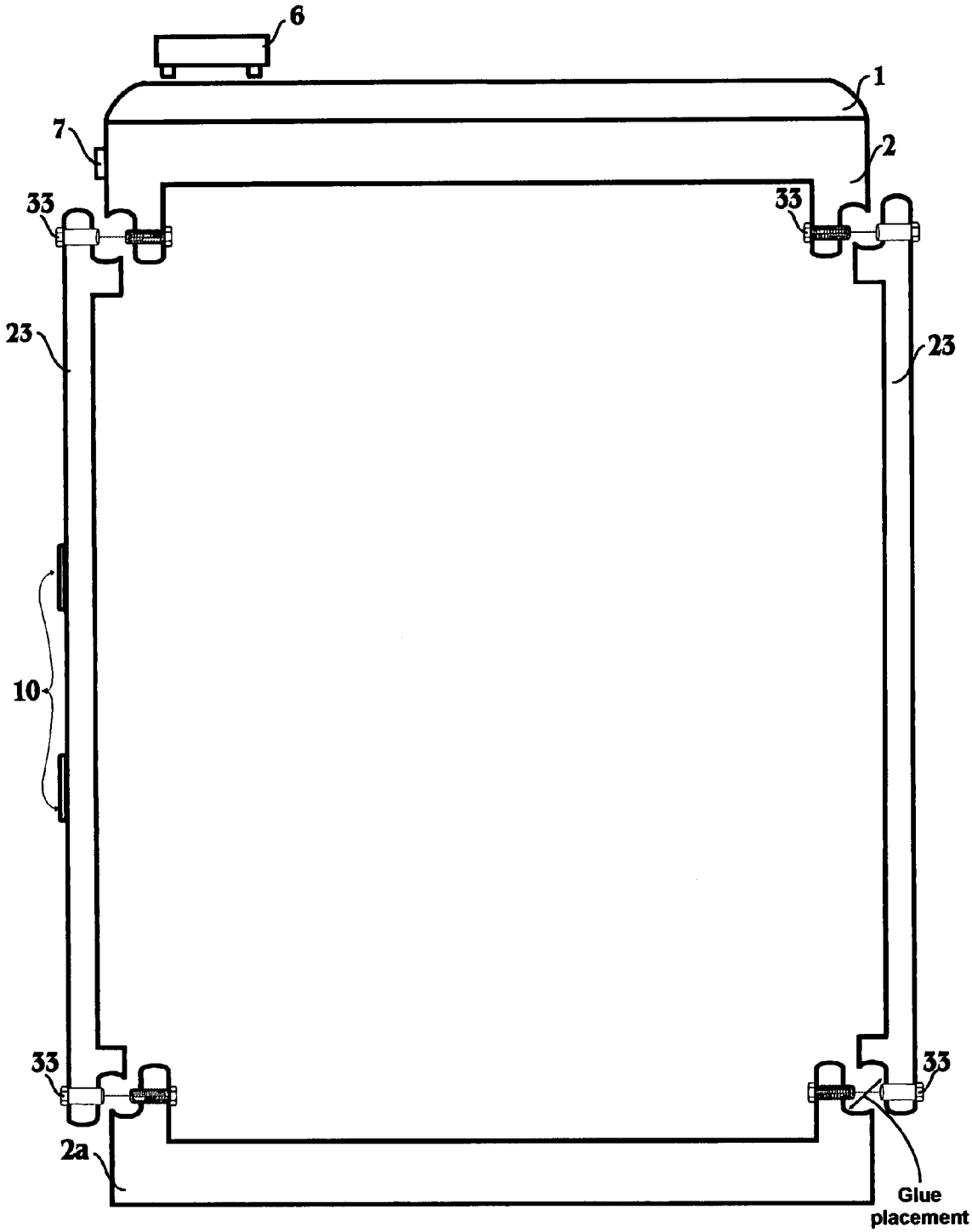
FIG. 7 depicts, top of mailbox item (1) which interlocks with panel items (2) as one piece with cosmetic seam line, interlocking panels are shaped from 1 inch down to ½ inch which create interlocking connections for interlocking panels items (2*a*) base of unit that sits upon ground, interlocking panel are shaped from 1 inch down to ½ inch which create interlocking connections, address placeholder item (6) for numbered address shown with top mount, flag holder item (7) signals postal worker outgoing mail awaiting pick-up, mailbox reflectors item (10) to reflect side of mailbox at night, division of interlocking panels item (2) top panel, (2*a*) base of front and back smooth exterior mailbox panels item (3) and item (23) side panels, shown where some sort of heavy duty clear glue will be placed to secure mailbox, screw with interlocking screw chamber item (33) to secure interlocking panels.

FIG. 7 depicts separation view of Safe "T" Box, showing 1 interlocks with panel 2 as one piece with ¼ inch cosmetic seam line between the two sections in front of mailbox to giving the illusion that 1 and 2 are separate sections, address placeholder 6 back view of housing for address is 6 inches long, 1½ inches high, ¼ inch thick, consisting of 5 numeral place holders for address, shown from front and side view if mailbox, numbers for address are 1 inch high, sticky backed numbers currently used on market today, address placeholder will have some sort of circular base attachments that will fit into pre-drilled circular holes for address placeholder to mount on top (FIG. 7), address placeholder is made from plastic, metal or some sort of fabricated material, conventional flag holder 7 mounted on the side of the mailbox, standard market item used today with screw attachment.

Separation of interlocking panels consisting of four interlocking panels that create enclosed mailbox, 2 top panel 3 smooth front exterior panel (FIG. 1), that attaches to interior of 2*a* (FIG. 6), rear exterior panel 3 (FIG. 4), that attaches to interior of 2*a* base panel, 23 side panel (FIG. 6), Exterior panels are 50 inches in height, 26 inches wide, smooth on exterior side of mailbox, trimmed on interior side to create interlocking components, made from some sort of fabricated material, interior interlocking panels, seams are glued with some sort of heavy duty clear glue in seam where interlocking panels are trimmed down from 1 inch to ½ inch thick, screwed with interlocking screw chamber 33 screws will be some sort of threaded post with screws, about 1 inch long, to secure interlocking panels.

Figure 8:
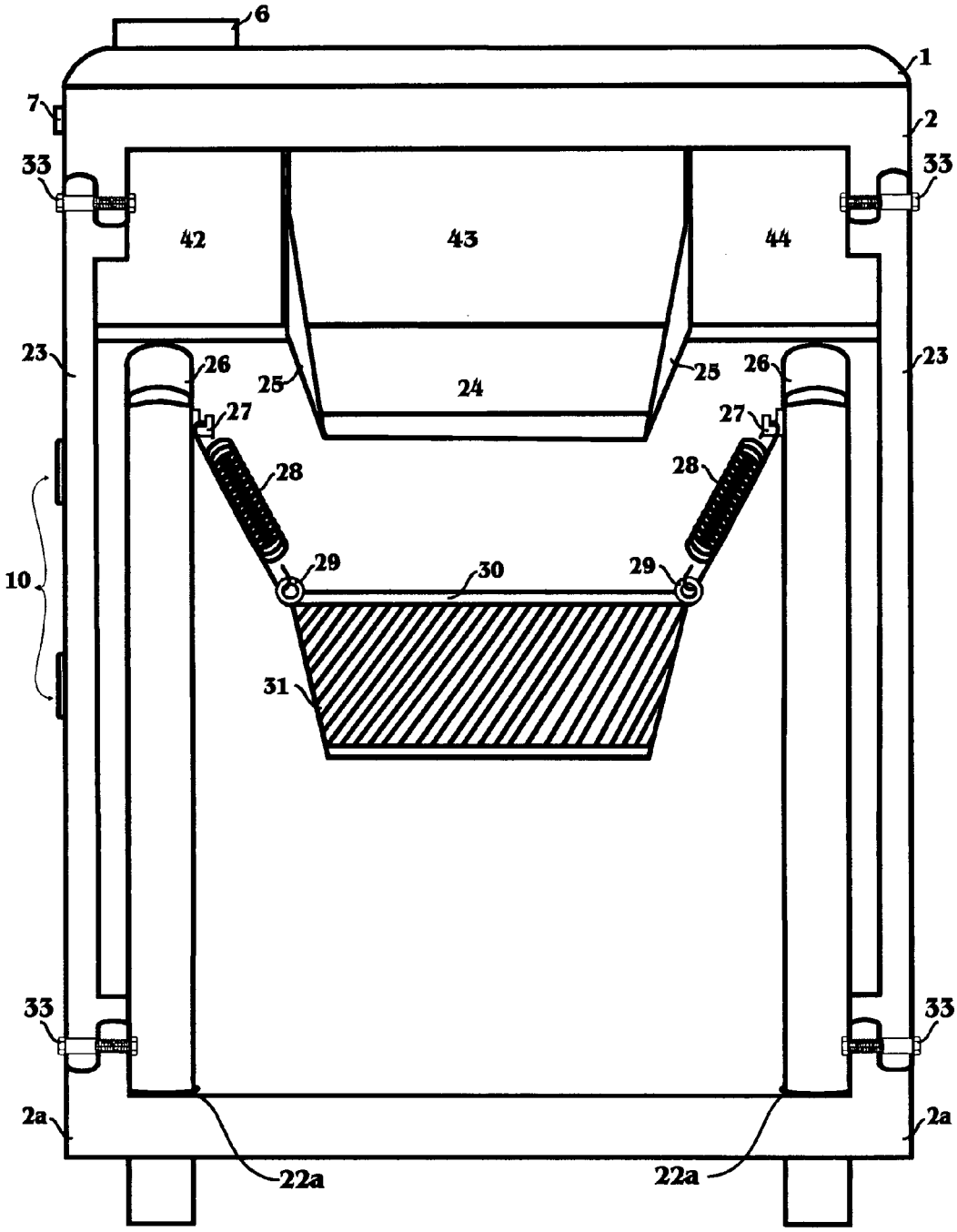
FIG. 8 depicts, internal view of Safe "T" Box, showing top of mailbox item (1) which interlocks with panel items (2) as one piece with cosmetic seam line, interlocking panels items (2*a*) base of unit that sits upon ground, interlocking panel are shaped from 1 inch down to ½ inch which create interlocking connections, address placeholder item (6) for address numbers, flag holder item (7) signals postal worker outgoing mail awaiting pick-up, mailbox reflectors item (10) to reflect side of mailbox at night, vertical handle item (11) attaches to door to open and close, plastic covers seals item (22*a*) plastic seal that go over internal poles, interlocking panels item (23) interlocking panel is shaped from 1 inch down to ½ inch which create interlocking connections, mailbox chute item (24) which mail travels into awaiting mailbox for pick-up, mailbox chute guardrail item (25) which guide mail into basket, internal poles item (26) that hold basket, hooks item (27) attach to internal poles, spring coils item (28) attach to hooks on internal poles, "O" rings item (29) attach to end basket and spring coils, basket item (31) holds mail secure for pick-up by homeowner, screw with interlocking screw chamber item (33) to secure interlocking panels, outgoing mail holding chamber item (42) chamber for outgoing mail, incoming mail chamber item (43) chamber for incoming mail that has mailbox chute attached, newspaper/advertisement chamber item (44) chamber for newspaper/advertisement once deposited rests upon for pick-up.

FIG. 8 depicts mailbox 1 26 inches wide by 26 inches long, interlocks with panel 2 as one piece with ¼ inch cosmetic seam line between the two sections for a combined length of 8 inches, 1 is ½ inch thick, 2 inches in height, has about a 15-degree raised top with about a 15-degree angled curved sides for rain or snow to runoff mailbox, 2 is 6 inches in height, 1-inch thick, corner portion of 2 is trimmed down from 1 inch to ½ inch thick, which interlocks with interlocking panel 23 which is trimmed down ½ inch to interlock with interlocking panel 2*a* seams are glued with some sort of heavy duty clear glue.

Address placeholder 6 back view of housing for address is 6 inches long, 1½ inches high, ¼ inch thick, consisting of 5 numeral place holders for address, numbers for address are 1 inch high, sticky backed numbers currently used on market today, address placeholder will have some sort of circular base attachments that will fit into pre-drilled circular holes for address placeholder to mount on top (FIG. 7), address placeholder is made from plastic, metal or some sort of fabricated material.

Flag holder 7 standard market item used today with screw attachment, mailbox reflectors 10 circle reflectors about 4 inches in height, either circle or square with sticky backing, reflectors come in different colors and attached to side of mailbox, homeowner can see side of mailbox at night when they approach driveway at night, plastic covers seals 22*a* four ½ inch circular plastic cover seals that slip over internal PVC poles 26 glued in place with some sort of heavy duty clear glue.

Incoming mail chamber 43 internal chamber for incoming mail is 10 inches wide, 12 inches in height, 25 inches long, ½ inch thick, chamber for incoming mail is divided into two sections to accommodate chute 24 angled mailbox chute 24 opening has 1-inch in length flat surface, ½ inch thick, opening space for mail deposited through chute is about 9 inches long, 12 inches high where slide is installed (FIG. 17), mail chute is on about a 32-degree angle, angled 12 inches long for mail to slide down slide into mailbox, attached to mailbox chute 24 are sidewalls guard 25 about 6 inches long, ¼ inch thick, controlling mail flow into basket 31 the other section of the incoming mail chamber is for the bumper board 32 (FIG. 9), bumper board 32 attaches to incoming mail chamber base is about 14½ inches inside the incoming mail chamber, bumper board is 10 inches wide, ½ inch thick, glued to the rear section of the base and inside sidewall of interior of incoming mail chamber (FIG. 17).

Internal poles 26 PVC poles total lengths are 42 inches, ½ inch hollow internal PVC poles, PVC pole height is 30 inches inside internal of mailbox, and internal PVC poles extend 12 inches out of mailbox into the ground.

Hooks 27 hooks are ½ inch in length and height, with about ¼ inch half "U" shaped end attach to 26 and spring coils 28 about 12 inches long with curved hooked on each end, made from plastic, metal or some sort of fabricated material, that attach to 27 and 29 to support basket 31 "O" rings 29 are ½ inch circular rings attached to corners of basket 31 made from some sort of plastic, metal or fabricated material to support the weight of basket, "O" rings could be used or left off of basket where spring coils 28 could directly be attached to each corner of basket giving equal support of basket, the basket 31 is 18 inches wide, 18 inches deep, made from some form of plastic, metal or fabricated material, finished basket could be made into a solid, diagonal or cross-stitched weaved pattern.

33 will be some sort of threaded post with screws, about 1 inch long, to secure interlocking panels 2 top panel 3 with smooth front exterior panel (FIG. 1), that attaches to interior of 2*a* (FIG. 6), rear exterior panel 3 (FIG. 4), that attaches to interior of 2*a* base panel, 23 side panel (FIG. 6), Exterior panels are 50 inches in height, 26 inches wide, smooth on exterior side of mailbox, trimmed on interior side to create interlocking components, made from some sort of fabricated material, interior interlocking panels, that create enclosure of mailbox.

Outgoing mail holding chamber 42 outgoing mail holding chamber is 7 inches wide, 12 inches in height, 25 inches long, ½ inch thick, chamber for outgoing mail to rest upon for pick-up, incoming mail chamber 43 internal chamber for incoming mail is 10 inches wide, 12 inches in height, 25 inches long, ½ inch thick, chamber for incoming mail is divided into two sections to accommodate mailbox chute 24 and bumper board 32 (FIG. 9), newspaper/advertisement chamber 44 newspaper/advertisement chamber that is 7 inches wide, 12 inches height, 25 inches in length, ½ inch thick, chamber for newspaper/advertisement or other items not being delivered by U.S. Postal Service is received for pick-up.

Figure 9:
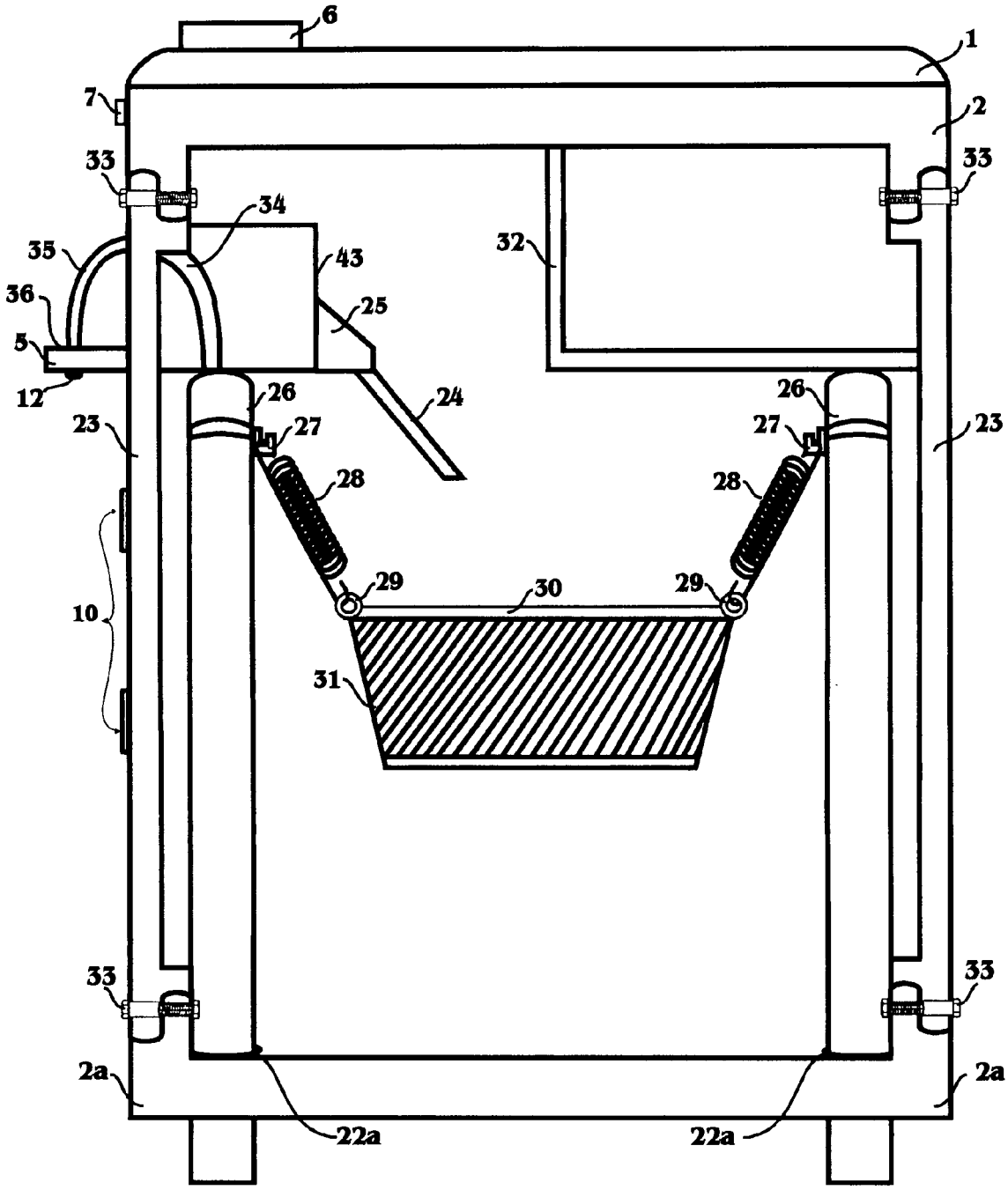
FIG. 9 depicts, internal side view of Safe "T" Box, showing top of mailbox item (1) which interlocks with panel items (2) as one piece with cosmetic seam line, interlocking panels items (2*a*) base of unit that sits upon ground, interlocking panel are shaped from 1 inch down to ½ inch which create interlocking connections, horizontal handle item (12) attaches to door to pull down and close, incoming mail and outgoing mail door are attached as one piece with a cosmetic seam line item (5), address placeholder item (6) for address numbers, flag holder item (7) signals postal worker outgoing mail awaiting pick-up, mailbox reflectors item (10) to reflect side of mailbox at night, plastic covers seals item (22*a*) plastic seal that goes over internal poles, interlocking panels (23) interlocking panel are shaped from 1 inch down to ½ inch which create interlocking connection, mailbox chute item (24) which mail travels into awaiting mailbox for pick-up, mailbox chute guardrail item (25) which guide mail into basket, internal poles item (26) that hold basket and extend 12 inches into the ground, hooks item (27) attach to internal poles, spring coils item (28) attach to hooks on internal poles, "O" rings item (29) attach to end basket and spring coils, basket item (31) holds mail secure for pick-up by homeowner, bumper board item (32) mail hits back of bumper board and falls into awaiting basket, screw with interlocking screw chamber item (33) to secure interlocking panels, 45-degree angled stationary arm housing item (34), for 45-degree angled retractable movable arm item (35) to retracts into when door is closed.

FIG. 9 depicts mailbox 1 is 26 inches wide by 26 inches long, interlocks with panel 2 as one piece with ¼ inch cosmetic seam line between the two sections for a combined length of 8 inches, 1 is ½ inch thick, 2 inches in height, has about a 15-degree raised top with about a 15-degree angled curved sides for rain or snow to runoff mailbox, 2 is 6 inches in height, 1-inch thick, corner portion of 2 is trimmed down from 1 inch to ½ inch thick, which interlocks with interlocking panel 23 which is trimmed down ½ inch to interlock with interlocking panel 2*a* seams are glued with some sort of heavy duty clear glue.

Outgoing, incoming mail door 5 that is 18-inch wide and 13 inches in height, thickness of the pull down door 5 is ½ inch thick, for incoming and outgoing mail, with horizontal handle 12 (FIG. 1), handle is 9 inches long, made from some sort of plastic, metal or fabricated material, handle is attached to inside door 5 with screws for pull down door to open or close.

Address placeholder 6 back view of housing for address placeholder is 6 inches long, 1½ inches high, ¼ inch thick, consisting of 5 numeral place holders for address, numbers for address are 1 inch high, sticky backed numbers currently used on market today, address placeholder will have some sort of circular base attachments that will fit into pre-drilled circular holes for address placeholder to mount on top (FIG. 7), address placeholder is made from plastic, metal or some sort of fabricated material, flag holder 7 standard market item used today with screw attachment, mailbox reflectors 10 reflectors about 4 inches in height, either circle or square with sticky backing, reflectors come in different colors and attached to side of mailbox, homeowner can see side of mailbox at night when they approach driveway at night, plastic covers seals 22*a* four ½ inch circular plastic cover seals that slip over internal PVC poles 26 glued in place with some sort of heavy duty clear glue.

Interlocking panels 23 1 inch thick interlocking panel, 50 inches tall, 26 inches wide, ends are trimmed from 1 inch to ½ inch thick, which creates interlocking chamber that connects to interlocking panels, 2 top panel 3 smooth front exterior panel (FIG. 1), that attaches to interior of 2*a* (FIG. 6), rear exterior panel 3 (FIG. 4), that attaches to interior of 2*a* base panel, 23 side panel (FIG. 6), Exterior panels are 50 inches in height, 26 inches wide, smooth on exterior side of mailbox, trimmed on interior side to create interlocking components, made from some sort of fabricated material, interior interlocking panels, seams are glued with some sort of heavy duty clear glue in seam where interlocking panels are trimmed down from 1 inch to ½ inch thick, screwed with interlocking screw chamber 33 screws will be some sort of threaded post with screws, about 1 inch long, to secure interlocking panels.

Incoming mail chamber 43 internal chamber for incoming mail is 10 inches wide, 12 inches in height, 25 inches long, ½ inch thick, chamber for incoming mail is divided into two sections to accommodate mail chute 24 mailbox chute 24 10 inches wide, 12 inches high, ½ inch thick, mail chute opening has 1-inch length flat lip, ½ inch thick before mailbox chute, mail chute is on about a 32-degree angle, 12 inches long for mail to slide down chute into mailbox, open space area for mail being deposited through chute is about 9 inches long, 12 inches high where slide is installed (FIG. 17), mail chute is on about a 32-degree angle, is angled 12 inches long for mail to slide down slide into mailbox, sidewalls guard 25 about 6 inches long, ¼ inch thick, controlling mail flow into awaiting basket 31 the basket 31 is 18 inches wide, 18 inches deep, made from some form of plastic, metal or fabricated material, finished basket could be made into a solid, diagonal or cross-stitched basket weave pattern.

Internal poles 26 PVC poles total lengths are 42 inches, ½ inch hollow internal poles, PVC pole height is 30 inches inside internal of mailbox, and internal PVC poles extend 12 inches out of mailbox into the ground.

Hooks 27 are ½ inch in length and height, with about ¼ inch half "U" shaped end attach to 26 and spring coils 28 about 12 inches long with curved hooked on each end, made from plastic, metal or some sort of fabricated material, that attach to 27 and 29 to support basket 31 "O" rings 29 are ½ inch circular rings attached to corners of basket 31 made from some sort of plastic, metal or fabricated material to support the weight of basket, "O" rings could be used or left off of basket where spring coils could be directly attached to each corner of basket equal support of basket, the basket 31 18 inches wide, 18 inches deep, made from some form of plastic, metal or fabricated material, finished basket could be made into a solid, diagonal or cross-stitched weaved pattern.

Bumper board 32 attaches to incoming mail chamber base about 14½ inches inside the incoming mail chamber, 10 inches wide, ½ inch thick, glued to the inside sidewalls and base of the interior of incoming mail chamber 43 (FIG. 17).

33 will be some sort of threaded post with screws, about 1 inch long, to secure interlocking panels connects to interlocking panels, 2 top panel 3 smooth front exterior panel (FIG. 1), that attaches to interior of 2*a* (FIG. 6), rear exterior panel 3 (FIG. 4), that attaches to interior of 2*a* base panel, 23 side panel (FIG. 6), glued with some sort of heavy duty clear glued together.

45-degree angled stationary arm housing 34 ½ inch hollow chamber, made from plastic, metal or some sort of fabricated material, 12½ inches long, shaped on a 45 degree angle. 45-degree angled retractable movable arm 35 ½ inch hollow chamber, made from plastic, metal or some sort of fabricated material, 12 inches long, shaped on a 45 degree angle, attached to 5 with some sort of heavy duty clear glue.

Thin rubber trim 36 rubber seam that is about ⅛ inch wide, length is determined by door being trimmed, glued with some sort of heavy duty glue.

Figure 10:
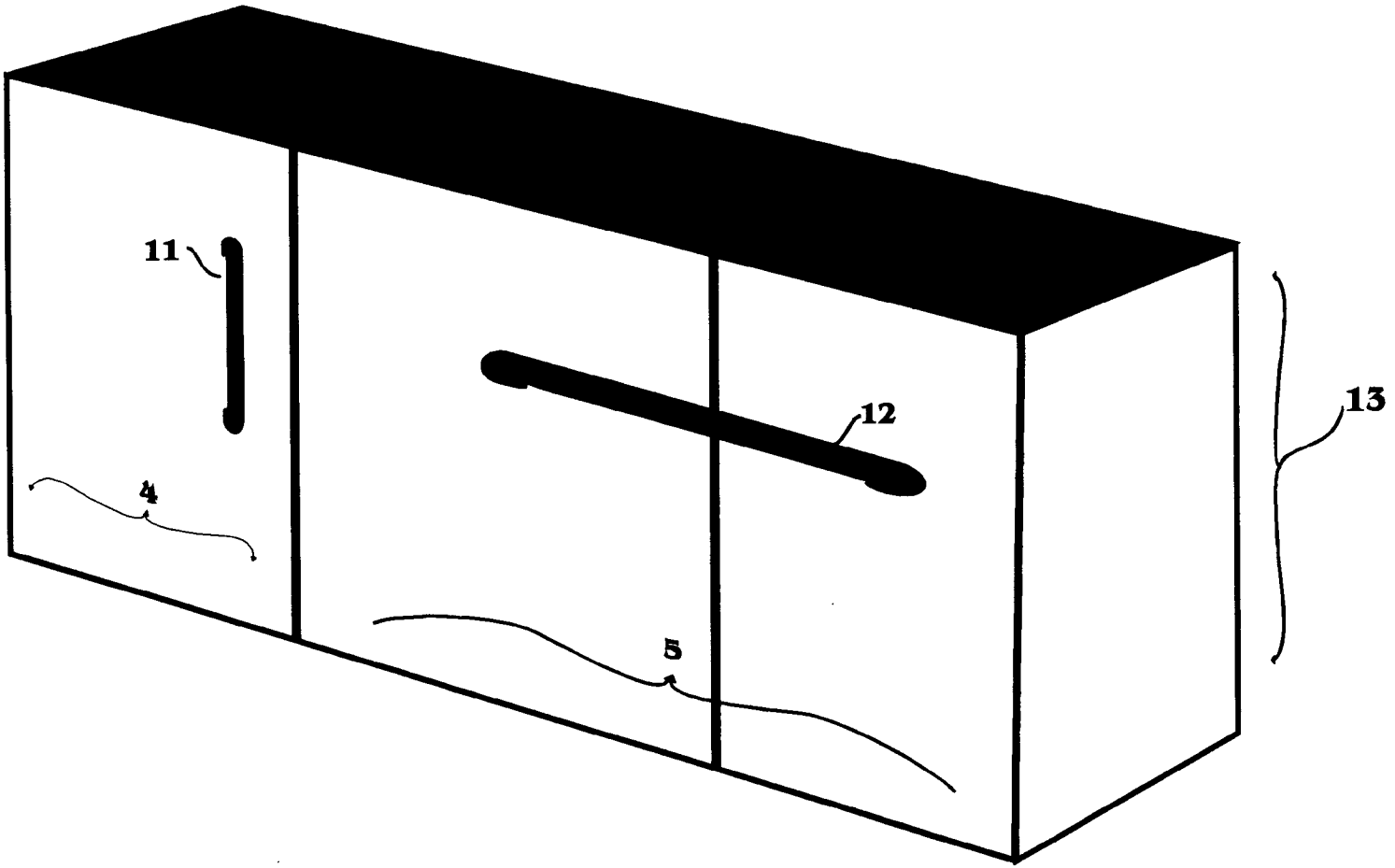
FIG. 10 depicts, front elongated housing chamber item (13) of Safe "T" Box with newspaper/advertisement door item (4) with vertical handle item (11) for swing door to open and close, incoming mail and outgoing mail door are attached as one piece with a cosmetic seam line item (5), with horizontal handle item (12) to pull door open and close.

FIG. 10 depicts side view of front of the elongated housing chamber 13 of mailbox, housing is 25 inches long by 25 inches wide, 14 inches high, consisting of a pull down retractable door 5 18-inch wide and 13 inches in height, is ½ inch thick, for incoming and outgoing mail, with horizontal handle 12 handle is 9 inches long, made from some sort of plastic, metal or fabricated material, attached to inside door 5 with screws for pull down door to open or close. Also, mounted in the front of the elongated housing chamber 13 is the newspaper/advertisement door 4 swing door, 8 inches wide, 13 inches high, ½ inch thick, that swings opens to insert newspaper/advertisement or other items not delivered via U.S. Postal Service and closes when not in use, vertical handle 11 handle is 7 inches long, made from some sort of plastic, metal or fabricated material, attached to inside door 4 with screws for the swinging door to pull open or close.

Figure 11:
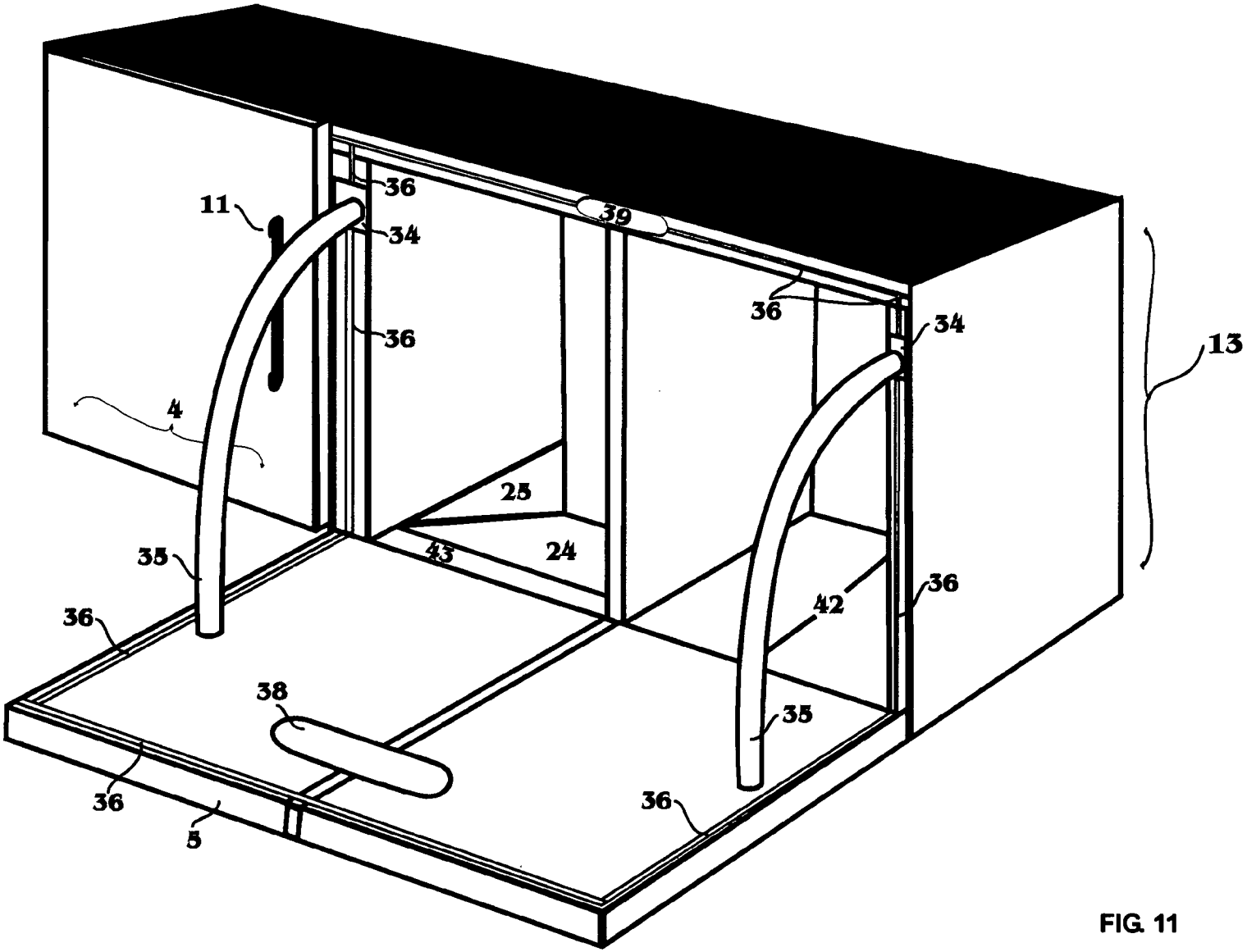
FIG. 11 depicts, front elongated housing chamber item (13) of Safe "T" Box with newspaper/advertisement door item (4) with vertical handle item (11) to swing door open and close, incoming and outgoing mail door attached as one piece with a cosmetic seam line item (5) shown with door open, mailbox chute item (24) which mail travels into mailbox for pick-up, mailbox chute guardrail item (25) which guides mail into basket item (34), 45-degree angled stationary arm stationary arm, 45-degree angled retractable movable arm item (35) that retracts when door is closed, thin rubber trim item (36) attached around the edge of each door to protect mail from getting wet, magnets item (38), (39) keeps door closed when not in use, outgoing mail holding chamber item (42) chamber for outgoing mail to rest in for pick-up.

FIG. 11 depicts side view of the elongated housing chamber 13 housing is 25 inches long by 25 inches wide, 14 inches high, consisting of a pull down retractable door 5 shown open, 18-inch wide and 13 inches in height, is ½ inch thick, for incoming and outgoing mail, with horizontal handle 12 (FIG. 10), handle is 9 inches long, made from some sort of plastic, metal or fabricated material, attached to inside door 5 with screws for pull down door to open or close, also mounted in the elongated housing chamber 13 is the newspaper/advertisement door 4 shown closed, has swing door, 8 inches wide, 13 inches high, ½ inch thick, that swings opens to insert newspaper/advertisement or other items not delivered via U.S. Postal Service and closes when not in use, vertical handle 11 handle is 7 inches long, made from some sort of plastic, metal or fabricated material, attached to inside door 4 with screws for the swinging door to pull open or close.

Mailbox chute 24 that is 10 inches wide, 13 inches high, ½ inch thick, mail chute opening has 1-inch length flat lip area ½ inch thick before mailbox chute, mail chute is on about a 32-degree angle, 12 inches long for mail to slide down chute into mailbox, open space area for mail being deposited through chute is about 9 inches long, mailbox chute guardrail 25 about 6 inches long, ¼ inch thick sides, controlling mail flow into basket.

45-degree angled stationary arm housing 34 (FIG. 12), ½ inch hollow chamber, made from plastic, metal or some sort of fabricated material, 12½ inches long, shaped on a 45 degree angle.

45-degree angled retractable movable arm 35 ½ inch hollow chamber, made from plastic, metal or some sort of fabricated material, 12 inches long, shaped on a 45 degree angle, attached to 5 with some sort of heavy duty clear glue.

Thin rubber trim 36 rubber seam that is about ⅛ inch wide, length is determined by door being trimmed, glued with some sort of heavy duty glue, magnets 38 and 39 current standard market magnets used today, about ¼ length that attaches to door 4 and 5 outgoing mail holding chamber 42 outgoing mail holding chamber that is 7 inches wide, 12 inches in height, 25 inches long, ½ inch thick, chamber for outgoing mail to rest upon for pick-up, incoming mail chamber 43 internal chamber for incoming mail is 10 inches wide, 12 inches in height, 25 inches long, ½ inch thick, chamber for incoming mail is divided into two sections to accommodate mailbox chute 24 and bumper board 32 (FIG. 9).

Figure 12:
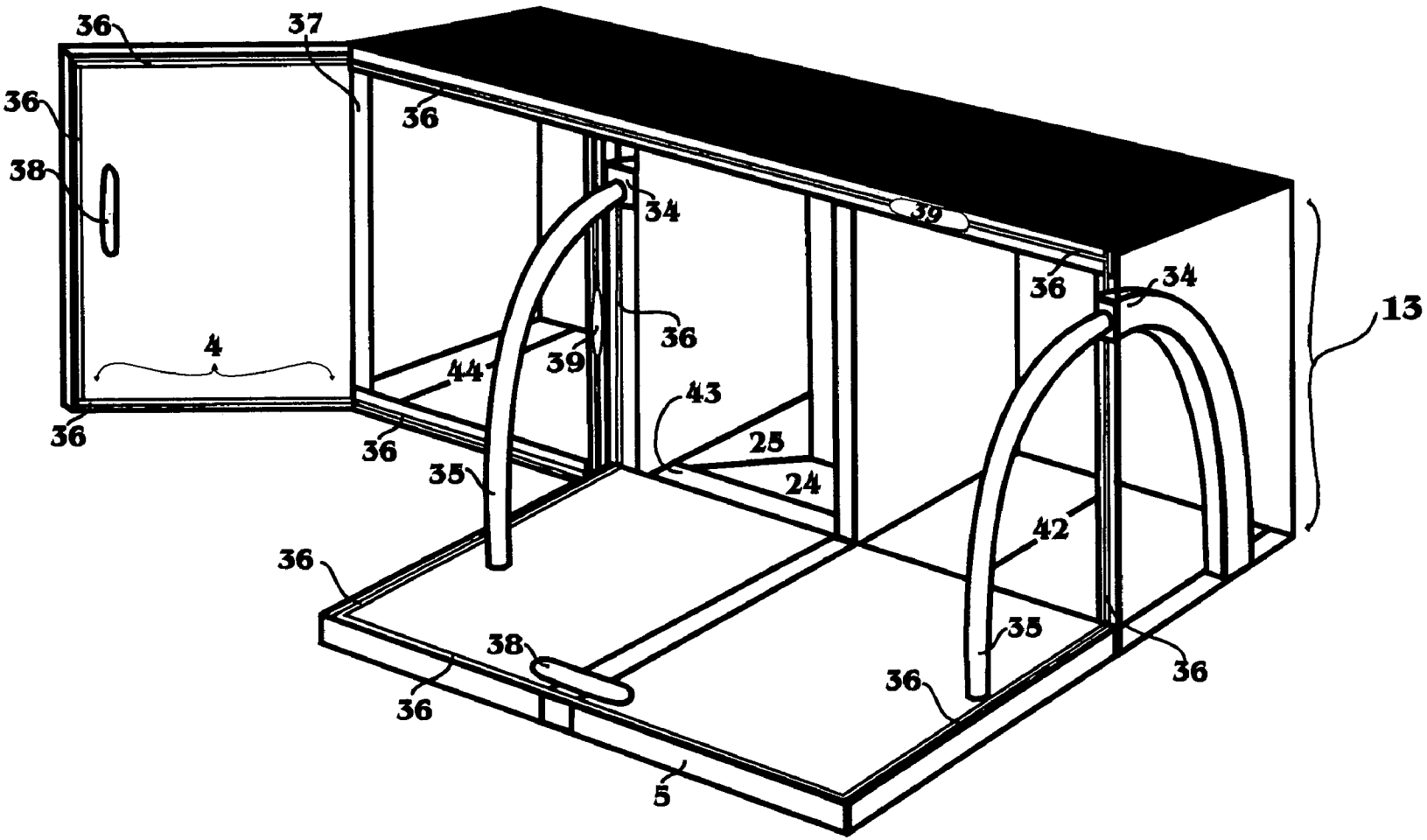
FIG. 12 depicts, front elongated housing chamber item (13) of Safe "T" Box with newspaper/advertisement door item (4) shown with door open, incoming mail and outgoing mail door attached as one piece with a cosmetic seam line item (5) with door open, mailbox chute item (24) which mail travels into mailbox for pick-up, mailbox chute guardrail item (25) which guides mail into basket, 45-degree angled stationary arm housing item (34), 45-degree angled retractable movable arm item (35) that retracts when door is closed, thin rubber trim item (36) attached around the edge of each door to protect mail from getting wet, stabilizer swing door pole item (37) enable door to swing open and close, magnets item (38), (39) keeps door closed when not in use, outgoing mail holding chamber item (42) chamber for outgoing mail to rest in for pick-up, newspaper/advertisement chamber item (44) chamber for newspaper/advertisement and other items to rest in for pick-up.

FIG. 12 depicts side view of front elongated housing chamber 13 housing is 25 inches long by 25 inches wide, 14 inches high, consisting of a pull down retractable door 5 18-inch wide and 13 inches in height, is ½ inch thick, for incoming and outgoing mail, with horizontal handle 12 (FIG. 10), handle is 9 inches long, made from some sort of plastic, metal or fabricated material, attached to inside door 5 with screws for pull down door to open or close, also mounted in the front elongated housing chamber 13 is the newspaper/advertisement door 4 with swing door open, 8 inches wide, 13 inches high, ½ inch thick, that swings opens to insert newspaper/advertisement or other items not delivered via U.S. Postal Service and closes when not in use, vertical handle 11 (FIG. 10), handle is 7 inches long, made from some sort of plastic, metal or fabricated material, attached to inside door 4 with screws for the swinging door to pull open or close.

Mailbox chute 24 that is 10 inches wide, 12 inches high, ½ inch thick, mail chute opening has 1-inch length flat lip, ½ inch thick before mailbox chute, mail chute is on about a 32-degree angle, 12 inches long for mail to slide down chute into mailbox, open space area for mail being deposited through chute is about 9 inches long, mailbox chute guardrail 25 about 6 inches long, ¼ inch thick sides, controlling mail flow into basket.

45-degree angled stationary arm housing 34 that is a ½ inch hollow chamber, made from plastic, metal or some sort of fabricated material, 12½ inches long, shaped on a 45 degree angle.

45-degree angled retractable movable arm 35 that is a ½ inch hollow chamber, made from plastic, metal or some sort of fabricated material, 12 inches long, shaped on a 45 degree angle, attached to 5 with some sort of heavy duty clear glue.

Thin rubber trim 36 rubber seam that is about ⅛ inch wide, length is determined by door being trimmed, glued with some sort of heavy duty glue, stabilizer swing door pole 37 about ½ hollow circular pole, 16 inches long, extends 1 inch into the upper interior portion of 2 about 1 inch down into the chambers 44 for swinging door 4 to open and close, magnets 38 and 39 current standard market magnets used today, about ¼ length that attaches to door 4 and 5 outgoing mail holding chamber 42 outgoing mail holding chamber that is 7 inches wide, 12 inches in height, 25 inches long, ½ inch thick, chamber for outgoing mail to rest upon for pick-up, incoming mail chamber 43 internal chamber for incoming mail is 10 inches wide, 12 inches in height, 25 inches long, ½ inch thick, chamber for incoming mail is divided into two sections to accommodate mailbox chute 24 and bumper board 32 (FIG. 9).

Newspaper/advertisement chamber 44 newspaper/advertisement chamber is 7 inches wide, 12 inches height, 25 inches, chamber for newspaper/advertisement to rest upon for pick-up by homeowner.

Figure 13:
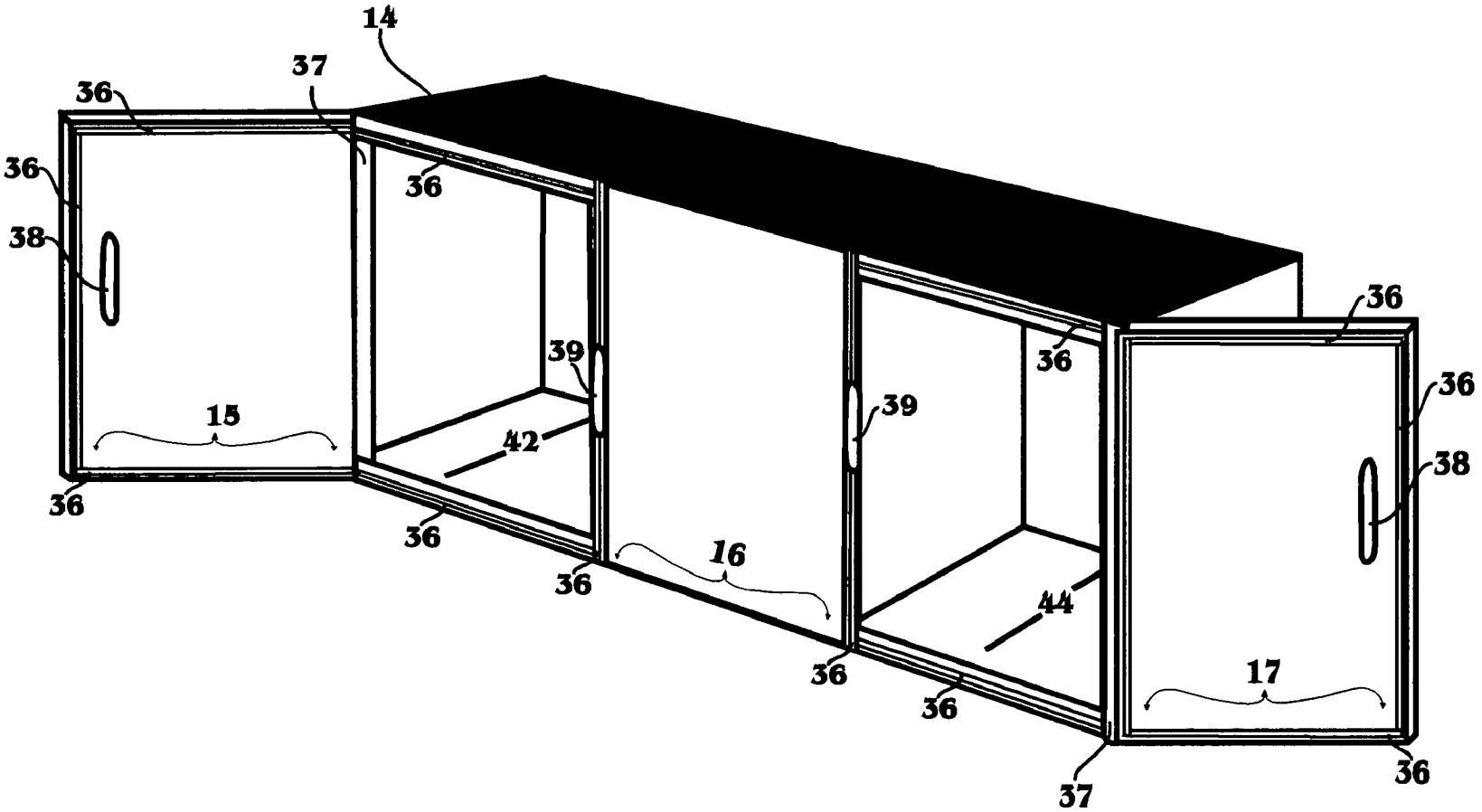
FIG. 13 depicts, rear elongated housing chamber item (14) of Safe "T" Box from back view, showing outgoing mail door item (15) that has a swing door shown open, rear non-functioning panel item (16) non-functioning panel is the back of the bumper board item (32), newspaper/advertisement door item (17) with swing door open, thin rubber trim item (36) attached around the edge of each door to protect mail from getting wet, stabilizer swing door pole item (37) enables door to swing open and close, magnets item (38), (39) keeps door closed when not in use, outgoing mail holding chamber item (42) chamber for outgoing mail to rest in for pick-up, newspaper/advertisement chamber item (44) chamber for newspaper/advertisement and other items to rest in for pick-up.

FIG. 13 depicts back view of rear upper elongated chamber 14 that attaches to front elongated housing chamber 13 in the rear of the mailbox, which front elongated housing chamber 13 is 25 inches long by 25 inches wide, 13 inches high which extends through upper chamber of mailbox to rear upper elongated chamber 14 and attaches to one another to make one continuous chamber, with ½ inch cosmetic seam line on top and bottom of rear upper elongated housing chamber, constructed from some sort of fabricated material as one piece.

Rear outgoing mail door 15 swinging door, 8 inches wide, 13 inches in height, ½ inch thick, that swings opens to retrieve newspaper/advertisement or other items not delivered via U.S. Postal Service and close when not in use, rear non-functioning panel 16 that is 9 inches wide by 13 inches high, ½ thick, non-functioning door panel is part of incoming mail chamber 43 (FIG. 17), rear newspaper/advertisement door 17 swinging door, 8 inches wide, 13 inches in height, ½ inch thick, that swings opens to retrieve newspaper/advertisement or other items not delivered via U.S. Postal Service and close when not in use.

Thin rubber trim 36 rubber seam that is about ⅛ inch wide, length is determined by items being trimmed, glued with some sort of heavy duty glue, stabilizer swing door pole 37 about ½ hollow circular pole, 16 inches long, extends 1 inch into the upper interior portion of 2 about 1 inch down into the chamber 42 for swing door 15 to open and close, stabilizer swing door pole 37 about ½ hollow circular pole, 16 inches long, extends 1 inch into the upper interior portion of 2 about 1 inch down into the chamber 44 for swing door 17 to swing open and close, magnets 38 and 39 current standard market magnets used today, about ¼ length that attaches to door 15 and 17 outgoing mail holding chamber 42 outgoing mail holding chamber, 7 inches wide, 12 inches in height, 25 inches long, ½ inch thick, chamber for outgoing mail to rest upon for pick-up, newspaper/advertisement chamber 44 newspaper/advertisement chamber that is 7 inches wide, 12 inches height, 25 inches, chamber for outgoing mail to rest upon for pick-up.

Figure 14:
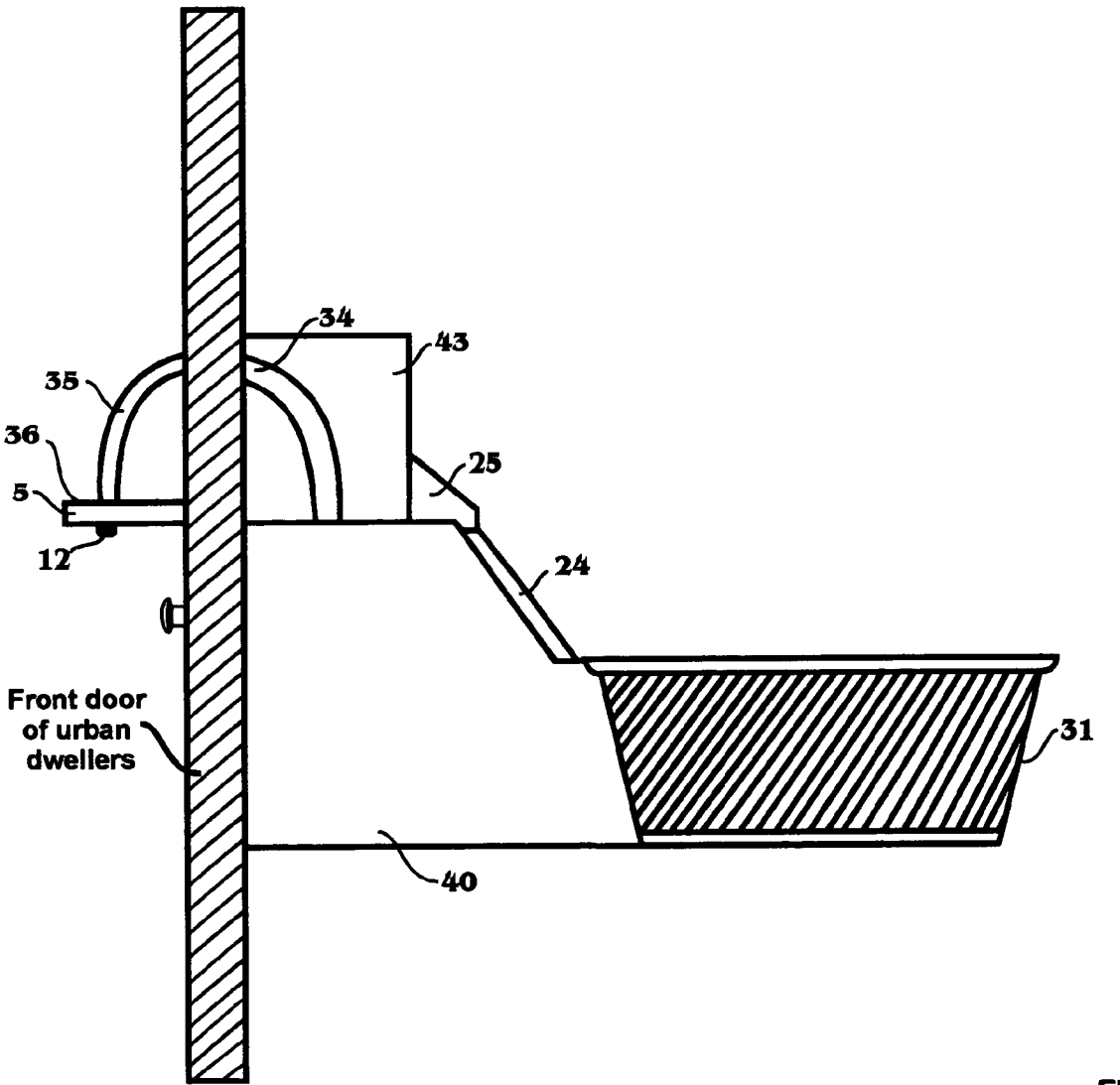
FIG. 14 depicts, some internal parts of the Safe "T" Box used to create the residential Safe "T" Box, incoming mail and outgoing mail door attached as one piece with a cosmetic seam line item (5) door open, flag holder item (7) signals postal worker outgoing mail awaiting pick-up, horizontal handle item (12) attaches to pull down door, mailbox chute item (24) which mail travels into awaiting mailbox for pick-up, mailbox chute guardrail item (25) which guide mail into basket, cross stitched weaved basket item (31) for incoming mail once deposited by the United Stated Postal Worker for pick-up, 45-degree angled stationary arm housing item (34), 45-degree angled retractable movable arm item (35) that retracts when door is closed, thin rubber trim item (36) attached around the edge of each door to protect mail from getting wet, holding basket item (40) that supports the weight of basket, incoming mail holding chamber item (43) chamber for incoming mail to rest in for pick-up.

FIG. 14 depicts how some of internal parts 5 12 24 25 31 34 35 36 40 and 43 are used to create the city design of Safe "T" Box mailbox, made from some sort of fabricated material, outgoing mail door and incoming mail door 5 pull down retractable door 5 that is 10 inches wide by 10 inches high, ½ inch thick, horizontal handle 12 handle is 5 inches long, made from some sort of plastic, metal or fabricated material, attached to inside door 5 with screws for pull down door to open or close, mailbox chute 24 that is 10 inches wide, 10 inches high, ½ inch thick, mail chute opening has 1-inch length flat lip area ½ inch thick before mailbox chute, mail chute is on about a 32-degree angle, 12 inches long for mail to slide down chute into mailbox, mailbox chute guardrail 25 about 4 inch length, ¼ inch thick sides, controlling mail flow into basket, basket 31 that is 18 inches wide, 18 inches deep, made from some form of plastic, metal or fabricated material, finished basket could be made into a solid, diagonal or cross-stitched basket weave pattern, 45-degree angled stationary arm housing 34 which is ½ inch hollow chamber, made from plastic, metal or some sort of fabricated material, 7½ inches long, shaped on a 45 degree angle, 45-degree angled retractable movable arm 35 which is ½ inch hollow chamber, made from plastic, metal or some sort of fabricated material, 7 inches long, shaped on a 45 degree angle, attached to 5 with some sort of heavy duty clear glue, holding rubber seals 36 made from some sort of thin rubber material that attaches around edge of doors 5 to protect mail from getting wet when doors not in use, basket 40 that is 18¼ inches wide, 18¼ inches deep, basket support is made from plastic, metal or some sort of fabricated material that supports the basket, incoming mail chamber 43 incoming mail chamber 43 incoming mail chamber, internal chamber for incoming mail is 10 inches wide, 10 inches in height, 12 inches long, ½ inch thick.

Figure 15:
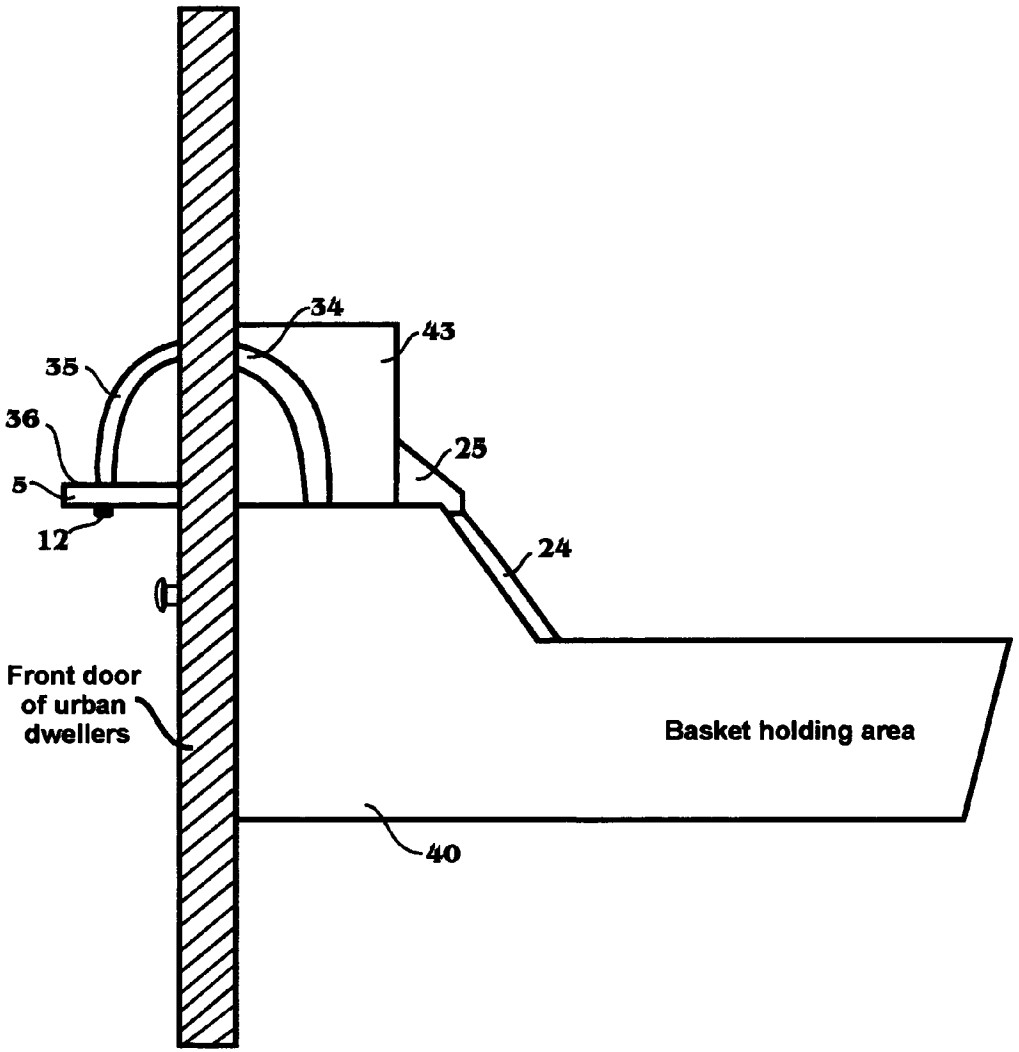
FIG. 15 depicts, some internal parts of the Safe "T" Box used to create the residential Safe "T" Box, incoming mail and outgoing mail door attached as one piece with a cosmetic seam line item (5) door open, flag holder item (7) signals postal worker outgoing mail awaiting pick-up, horizontal handle item (12) attaches to pull down door, mailbox chute item (24) which mail travels into awaiting mailbox for pick-up, mailbox chute guardrail item (25) which guide mail into basket, 45-degree angled stationary arm housing item (34), 45-degree angled retractable movable arm item (35) that retracts when door is closed, thin rubber trim item (36) attached around the edge of each door to protect mail from getting wet, holding basket item (40) that supports the weight of basket, incoming mail holding chamber item (43) chamber for incoming mail to rest in for pick-up.

FIG. 15 depicts how some of internal parts 5 12 24 25 34 35 36 40 and 43 are used to create the city design of Safe "T" Box mailbox, made from some sort of fabricated material, outgoing mail door and incoming mail door 5 pull down retractable door 5 10 inches wide by 10 inches high, ½ inch thick, horizontal handle 12 handle is 5 inches long, made from some sort of plastic, metal or fabricated material, attached to inside door 5 with screws for pull down door to open or close, mailbox chute 24 that is 10 inches wide, 10 inches high, ½ inch thick, mail chute opening has 1-inch length flat lip, ½ inch thick before mailbox chute, mail chute is on about a 32-degree angle, 12 inches long for mail to slide down chute into mailbox, mailbox chute guardrail 25 about 4 inch length, ¼ inch thick sides, controlling mail flow into basket, basket 31 (FIG. 14), 18 inches wide, 18 inches deep, made from some form of plastic, metal or fabricated material, finished basket could be made into a solid, diagonal or cross-stitched basket weave pattern.

45-degree angled stationary arm housing 34 which is ½ inch hollow chamber, made from plastic, metal or some sort of fabricated material, 7½ inches long, shaped on a 45 degree angle.

45-degree angled retractable movable arm 35 which is ½ inch hollow chamber, made from plastic, metal or some sort of fabricated material, 7 inches long, shaped on a 45 degree angle, attached to 5 with some sort of heavy duty clear glue.

Thin rubber trim 36 made from some sort of thin rubber material that attaches around edge of doors 5 to protect mail from getting wet when doors not in use, incoming mail chamber 43 internal chamber for incoming mail is 10 inches wide, 10 inches in height, 12 inches long, ½ inch thick.

Figure 16:
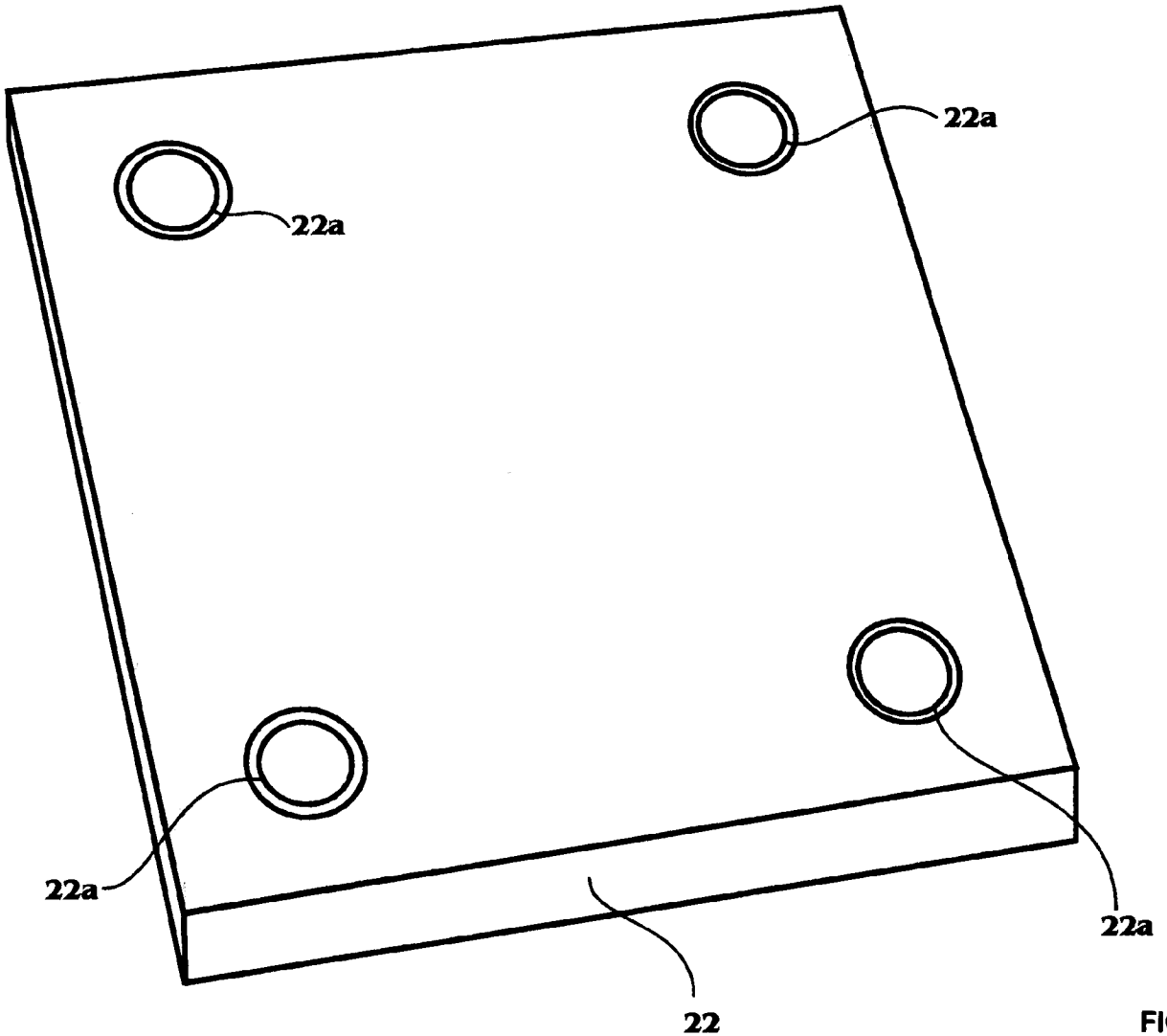
FIG. 16 depicts, internal base unit item (22) that attaches to the inside base of the mailbox, shown with 4 plastic covers seals item (22*a*) that slip over internal PVC poles item (26) that insert through the mailbox and into the ground.

FIG. 16 depicts internal base unit 22 square base, ½ inch thick, square, approximately 25¾ inches wide by 25¾ inches wide, attaches to the base of the mailbox, made from some sort of fabricated material, glued around edges with some sort of heavy duty glue, four ½ inch circular cut out holes are made in 22 for insertion of internal poles 26 (FIG. 8), that extend through the mailbox into the ground, plastic covers seals 22*a* four ½ inch circular plastic cover seals that slip over internal PVC poles 26 glued in place with some sort of heavy duty clear glue.

FIG. 17 showing view of front elongated housing chamber 13 without top cover, detailing views of inside chambers for housing that is 25 inches long by 25 inches wide, 13 inches high, consisting of a pull down retractable door 5 18-inch wide and 13 inches in height, is ½ inch thick, for incoming and outgoing mail, with horizontal handle 12 (FIG. 10), handle is 9 inches long, made from some sort of plastic, metal or fabricated material, attached to inside door with screws for pull down door to open or close, also mounted in the front elongated housing chamber 13 is the newspaper/advertisement door 4 with swing door open, 8 inches wide, 13 inches high, ½ inch thick, that swings opens to insert newspaper/advertisement or other items not delivered via U.S. Postal Service and closes when not in use, vertical handle 11 (FIG. 10), handle is 7 inches long, made from some sort of plastic, metal or fabricated material, attached to inside door 4 with screws for the swinging door to pull open or close, rear non-functioning panel 16 that is 9 inches wide by 13 inches high, ½ thick, non-functioning door panel is part of incoming mail chamber 43.

Mailbox chute 24 that is 10 inches wide, 12 inches high, ½ inch thick, mail chute opening has 1-inch length flat lip, ½ inch thick before mailbox chute, mail chute is on about a 32-degree angle, 12 inches long for mail to slide down chute into mailbox, open space area for mail being deposited through chute is about 9 inches long, mailbox chute guardrail 25 about 6 inches long, ¼ inch thick sides, controlling mail flow into basket, bumper board 32 attaches to incoming mail chamber base 14½ inches inside the incoming mail chamber, 10 inches wide, ½ inch thick, glued to the inside sidewall of interior of incoming mail chamber 43.

45-degree angled stationary arm housing 34 which is ½ inch hollow chamber, made from plastic, metal or some sort of fabricated material, 12½ inches long, shaped on a 45 degree angle.

45-degree angled retractable movable arm 35 which is ½ inch hollow chamber, made from plastic, metal or some sort of fabricated material, 12 inches long, shaped on a 45 degree angle, attached to 5 with some sort of heavy duty clear glue.

Thin rubber trim 36 rubber seam that is about ⅛ inch wide, length is determined by door being trimmed, glued with some sort of heavy duty glue, stabilizer swing door pole 37 about ½ hollow circular pole, 16 inches long, extends 1 inch into the upper interior portion of 2 about 1 inch down into the chamber 44 for swinging door 4 to open and close.

Stabilizer swing door pole 37 about ½ hollow circular pole, 16 inches long, extends 1 inch into the upper interior portion of 2 about 1 inch down into the chamber 44 for swing door 4 to open and close.

Stabilizer swing door pole 37 about ½ hollow circular pole, 16 inches long, extends 1 inch into the rear upper interior portion of 2 about 1 inch down into the chamber 42 for swing door 15 to swing open and close (FIG. 13).

Stabilizer swing door pole 37 about ½ hollow circular pole, 16 inches long, extends 1 inch into the rear upper interior portion of 2 about 1 inch down into the chamber 44 for swing door 17 to swing open and close (FIG. 13).

Magnets 38 and 39, current standard market magnets used today, about ¼ length that attaches to door 4 and 5 outgoing mail holding chamber 42 outgoing mail holding chamber that is 7 inches wide, 12 inches in height, 25 inches long, ½ inch thick, chamber for outgoing mail to rest upon for pick-up, incoming mail chamber internal chamber for incoming mail is 10 inches wide, 12 inches in height, 25 inches long, ½ inch thick, chamber for incoming mail is divided into two sections to accommodate mailbox chute 24 and bumper board 32.

Newspaper/advertisement chamber 44 newspaper/advertisement chamber that is 7 inches wide, 12 inches height, 25 inches, chamber for newspaper/advertisement to rest upon for pick-up by homeowner.

I claim:

1. A security mailbox comprising:

a front panel, rear panel, two side panels, top panel, and base panel cooperating to define an enclosure;

the base panel including four circular cut-outs receiving four poles therethrough, an upper portion of the poles extending into the enclosure, a lower portion of the poles extending below the enclosure and adapted to be cemented into the ground under the mailbox for support thereof, and four circular plastic seals receiving the respective pole therethrough and placed in the respective circular cut-out;

the front panel including two operable doors, a first of the two doors opening and closing a front entrance to an internal compartment for newspaper, a second of the two doors opening an closing both a mail chute for incoming mail and a front entrance to an internal compartment for outgoing mail;

the rear panel including two upper operable doors opening and closing a rear entrance to the internal compartments for newspaper and outgoing mail;

the rear panel including a lower sliding door with a lock assembly to access the incoming mail deposited into the enclosure via the mail chute;

a basket to receive the incoming mail deposited into the enclosure via the mail chute, the basket including four circular rings which are attached to four respective metal coil springs, wherein the four springs are attached to four respective clamps which are attached to the upper portion of the four respective poles, whereby the basket is suspended within the enclosure;

a bumper board position in the interior of the enclosure to direct the incoming mail deposited into the mail chute into the basket, the bumper board being spaced forward of the rear panel and aligned with and behind the mail chute so as to extend between the internal compartments for newspaper and outgoing mail;

an address holder for displaying an address having circular base attachments extending from a bottom surface thereof which fit into predrilled holes in the top panel; and a flag holder attached to one of the side panels for mounting a flag.

2. The security mailbox according to claim 1, further comprising a name plate attached to the front panel.

3. The security mailbox according to claim 1, further comprising reflectors attached to one of the side panels for locating the mailbox at night.

4. The security mailbox according to claim 1, further comprising an adhesive design element attached to the front panel.

5. The security mailbox according to claim 1, further comprising an awning attached to the rear panel above the lower sliding door to protect the lock assembly from rusting due to rain and snow runoff.

6. The security mailbox according to claim 1, further comprising door handles for each of the two operable doors of the front panel and the two operable doors of the rear panel.

7. The security mailbox according to claim 1, further comprising an interlockable attachment device mounted to at least one of the two side panels adapted for securing an adjacent second security mailbox.

* * * * *